US012595611B2

(12) United States Patent
Shin et al.

(10) Patent No.: US 12,595,611 B2
(45) Date of Patent: Apr. 7, 2026

(54) CLOTHES TREATMENT APPARATUS

(71) Applicant: LG Electronics Inc., Seoul (KR)

(72) Inventors: Joongil Shin, Seoul (KR); Kyuchul Lee, Seoul (KR); Hyunseung Lee, Seoul (KR); Hansol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 190 days.

(21) Appl. No.: 18/575,076

(22) PCT Filed: Jun. 17, 2022

(86) PCT No.: PCT/KR2022/008609
§ 371 (c)(1),
(2) Date: Dec. 28, 2023

(87) PCT Pub. No.: WO2023/277412
PCT Pub. Date: Jan. 5, 2023

(65) Prior Publication Data

US 2024/0426039 A1 Dec. 26, 2024

(30) Foreign Application Priority Data

Jun. 28, 2021 (KR) ..... 10-2021-0083905

(51) Int. Cl.
*D06F 34/30* (2020.01)
*D06F 34/08* (2020.01)
(Continued)

(52) U.S. Cl.
CPC ..... *D06F 34/30* (2020.02); *D06F 34/08* (2020.02); *D06F 34/32* (2020.02); *D06F 34/34* (2020.02)

(58) Field of Classification Search
None
See application file for complete search history.

(56) References Cited

U.S. PATENT DOCUMENTS

| | | | | |
|---|---|---|---|---|
| 10,060,066 | B2 * | 8/2018 | Anand | D06F 34/32 |
| 2008/0225016 | A1 | 9/2008 | Lee | |
| 2017/0137991 | A1 | 5/2017 | Pellegrin et al. | |

FOREIGN PATENT DOCUMENTS

| | | |
|---|---|---|
| CN | 106480657 | 3/2017 |
| EP | 3474721 | 6/2020 |

(Continued)

OTHER PUBLICATIONS

International Search Report and Written Opinion in Appln. No. PCT/KR2022/008609, mailed on Oct. 4, 2022, 18 pages (with English translation).

(Continued)

*Primary Examiner* — Rita P Adhlakha
(74) *Attorney, Agent, or Firm* — Fish & Richardson P.C.

(57) ABSTRACT

The present application relates to a clothes treatment apparatus comprising: a cabinet made of a conductive material provided with a mounting panel in which a panel inlet and a button mounting part are formed; a drum rotatably provided in the cabinet to accommodate clothes and having a drum inlet communicating with the panel inlet; buttons made of a non-conductive material coupled to the button mounting part and exposed to the outside of the cabinet; a button touch film fixed to a surface facing the direction in which the drum is positioned among the buttons to detect whether a user's body is in contact with the buttons; and a first circuit board positioned inside the cabinet and provided to receive a signal sensed by the button touch film.

20 Claims, 25 Drawing Sheets

(51) Int. Cl.
*D06F 34/32* (2020.01)
*D06F 34/34* (2020.01)

(56) References Cited

FOREIGN PATENT DOCUMENTS

| | | | |
|---|---|---|---|
| EP | 3783144 | A1 | 2/2021 |
| KR | 10-2005- 0123430 | | 12/2005 |
| KR | 10-2010- 0094676 | | 8/2010 |
| KR | 10-2016- 0062918 | | 6/2016 |

OTHER PUBLICATIONS

Office Action in Korean Appln. No. 10-2021-0083905, mailed on Dec. 20, 2023, 8 pages (with English translation).
European Search Report in European Appln. No. 22833468.6, mailed on Jun. 16, 2025, 9 pages.

* cited by examiner

CLOTHES TREATMENT APPARATUS

CROSS-REFERENCE TO RELATED APPLICATIONS

This application is a National Phase application under 35 U.S.C. 371 of International Application No. PCT/KR2022/008609, filed on Jun. 17, 2022, which claims the benefit of Korean Application No. 10-2021-0083905, filed on Jun. 28, 2021, the contents of which are incorporated by reference herein in their entirety.

TECHNICAL FIELD

This application relates to a laundry treatment apparatus.

BACKGROUND

A laundry treatment apparatus may include any device capable of performing clothing treatment, such as washing, drying, or caring for the fabrics of clothing. Among laundry treatment apparatuses, a washing machine represents a device that removes contaminants from laundry by the action of detergent and water.

Washing machines may be categorized into agitation, vortex, and drum type washing machines according to the washing method. The agitation type machine washes clothing by rotating a washing rod protruding upward from the center of the tub from side to side. The vortex type washing machine washes laundry using friction between the water current and the laundry caused by rotating a disk-shaped pulsator provided in the lower part of the tub. The drum type washing machine washes laundry by placing water, detergent, and laundry in a drum having a number of lifters, which protrude from the inner surface of the drum, and rotating the drum.

There is a drum type washing machine (Korean Patent Application Publication No. 10-2007-0044192) among the conventional laundry treatment apparatuses. The drum type washing machine includes a housing defining an outer appearance and a control panel disposed at an upper portion of a front side of the housing to select an operation of the washing machine. The control panel is manufactured separately from the housing and then coupled to the housing. The control panel is provided with multiple buttons allowing a user to select various functions of the washing machine. The buttons provided on the control panel are physical buttons inserted or withdrawn according to a physical pressure to recognize an input. In addition, the buttons are arranged to be coupled to the inside of the control panel. In addition, the control panel and the buttons are generally formed of a synthetic resin material.

Another conventional laundry treatment apparatus is provided with an input/output device (interface) for a user to input control instructions to an electronic device (Korean Patent Application Publication No. 10-2014-0023986). Interfaces provided in the conventional laundry treatment apparatus include a display part configured to display control instructions selectable by the user, a search part configured for the user to search control instructions displayed on the display part, a selector allowing the user to select a control instruction displayed on the display part, and an input unit configured to request execution of the control instruction selected by the user. These interfaces are designed to be disposed in spaces separated from each other.

SUMMARY

An object of the present disclosure is to provide a laundry treatment apparatus in which an input button for inputting a control instruction is directly coupled to a cabinet defining an outer appearance.

Another object of the present disclosure is to provide a laundry treatment apparatus capable of simplifying an assembly process and reducing time required for assembly by coupling an input button from the outside of a cabinet.

Another object of the present disclosure is to provide a laundry treatment apparatus having improved assemblability as a structure for guiding a coupling position in coupling an input button to a cabinet is provided.

Another object of the present disclosure is to provide a laundry treatment apparatus having a touch type input button that allows an inputting operation to be performed when a body of use comes into contact therewith.

Another object of the present disclosure is to provide a laundry treatment apparatus adopting a structure capable of preventing internal circuits from being damaged in a surge test applying a high voltage to a cabinet.

Another object of the present disclosure is to provide a laundry treatment apparatus capable of preventing foreign substances from being introduced through a gap in a portion in which an input button is mounted.

Another object of the present disclosure is to provide a laundry treatment apparatus having an interface in which display of control instructions, search or change of displayed control instructions, and selection of the displayed control instructions are integrated into one device.

The objects of the present disclosure can be achieved by providing a laundry treating apparatus including a cabinet formed of a metal material and having a mounting panel provided with a button mounting, a non-conductive button coupled to the button mounting portion and exposed to an outside of the cabinet, and a button touch film configured to sense whether a body of a user is in contact with the button.

The present disclosure may also include a button protective rib protruding from the button to surround the button touch film.

In one aspect of the present disclosure, provided herein is a laundry treatment apparatus including a cabinet formed of a conductive material and having a mounting panel, the mounting panel being provided with a panel inlet and a button mounting portion, a drum rotatably arranged inside the cabinet to accommodate laundry, the drum having a drum inlet communicating with the panel inlet, a non-conductive button coupled to the button mounting portion and exposed to an outside of the cabinet, a button touch film fixed to a surface of the button facing a position of the drum, the button touch film being configured to sense whether a body of a user is in contact with the button, and a first circuit board provided with a circuit to control rotation of the drum and configured to receive a signal of the sensing from the button touch film.

The button may include a button protective rib protruding from the surface of the button facing the position of the drum, wherein the button touch film may be disposed inside the button protective rib.

The button may include a button body disposed on the button mounting portion and exposed to the outside of the cabinet to allow the body of the user to contact the button body, and a button extension body extending from an edge of the button body and disposed inside the cabinet.

The button touch film may be fixed to surfaces of the button body and the button extension body facing the position of the drum, wherein the button protective rib may be disposed on the button body and the button extension body.

The laundry treatment apparatus may further include a button conductor connecting the button touch film to the first circuit board, wherein the button conductor may connect a portion of the button touch film fixed to the button extension body to the first circuit board.

The button protective rib may include a first protective rib disposed on the button body and a second protective rib disposed on the button extension body. The first protective rib and the second protective rib may be integrated to form a closed curve The button protective rib may a first protective rib disposed on the button body, a second protective rib disposed on the button extending body, and a protective rib cut-open portion formed by cutting away a portion of the second protective rib positioned on a side facing away from the first protective rib. The first protective rib and the second protective rib may be integrated to form an open curve opened on one side having the protective rib cut-open portion.

The laundry treatment apparatus may further include a button conductor connecting the button touch film to the first circuit board, wherein the protective rib may be disposed to surround at least a portion of the button conductor.

The button mounting portion may include a button mounting hole formed through the mounting panel in a penetrating manner, a button accommodation rib extending from an edge of the button mounting hole toward the position of the drum, and a button seating rib extending from the button accommodation rib toward a center of the button mounting hole, wherein the button may include a button coupling body extending from the button body toward the position of the drum to couple the button body to the mounting panel.

The button coupling body may be coupled to the button seating rib to support the button body.

The button protective rib may be spaced apart from the button accommodation rib in a direction away from the button accommodation rib.

The button protective rib may have a protruding height greater than or equal to an extension length of the button coupling body.

A free end of the button protective rib may be positioned closer to the first circuit board than the button seating rib.

The button mounting portion may further include a rib cut-open portion formed by removing a portion of the button accommodation rib and the button seating rib, wherein the button extension body may be disposed in the rib cut-open portion.

The cabinet may further include a panel through-hole formed through the mounting panel in a penetrating manner. The laundry treatment apparatus may further include an encoder including a fixed part fixed to the first circuit board, a rotary part rotatably coupled to the fixed part, and a signal generator configured to generate an electrical signal when the rotary part rotates, an actuator including a shaft inserted into the panel through-hole and coupled to the rotary part, a shaft through-hole formed through the shaft in a penetrating manner to receive the rotary part inserted thereinto, a handle fixed to the shaft so as to be positioned on an outside of the cabinet and configured to receive an input of force necessary for rotation of the shaft, an accommodation space provided inside the handle and communicating with the shaft through-hole, and a handle through-hole formed through one surface of the handle to allow the accommodation space to communicate with an outside therethrough, and a display part including a fastening body inserted into the shaft through-hole and fixed to the fixed part, an accommodation body fixed to the fastening body and disposed inside the accommodation space, and a display fixed to the accommodation body to face the handle through-hole and configured to display information.

The display may be configured to display preset information according to the electrical signal generated by the signal generator.

The present disclosure may provide a laundry treatment apparatus in which an input button for inputting a control instruction is directly coupled to a cabinet defining an outer appearance.

Further, the present disclosure may provide a laundry treatment apparatus capable of simplifying an assembly process and reducing time required for assembly by coupling an input button from the outside of a cabinet.

Further, the present disclosure may provide a laundry treatment apparatus having improved assemblability as a structure for guiding a coupling position in coupling an input button to a cabinet is provided.

Further, the present disclosure may provide a laundry treatment apparatus having a touch type input button that allows an inputting operation to be performed when a body of use comes into contact therewith.

Further, the present disclosure may provide a laundry treatment apparatus adopting a structure capable of preventing internal circuits from being damaged in a surge test applying a high voltage to a cabinet.

Further, the present disclosure may provide a laundry treatment apparatus capable of preventing foreign substances from being introduced through a gap in a portion in which an input button is mounted.

Further, the present disclosure may provide a laundry treatment apparatus having an interface in which display of control instructions, search or change of displayed control instructions, and selection of the displayed control instructions are integrated into one device.

DETAILED DESCRIPTION

Hereinafter, a preferred embodiment of a laundry treatment apparatus will be described in detail with reference to the accompanying drawings.

Figure 1:
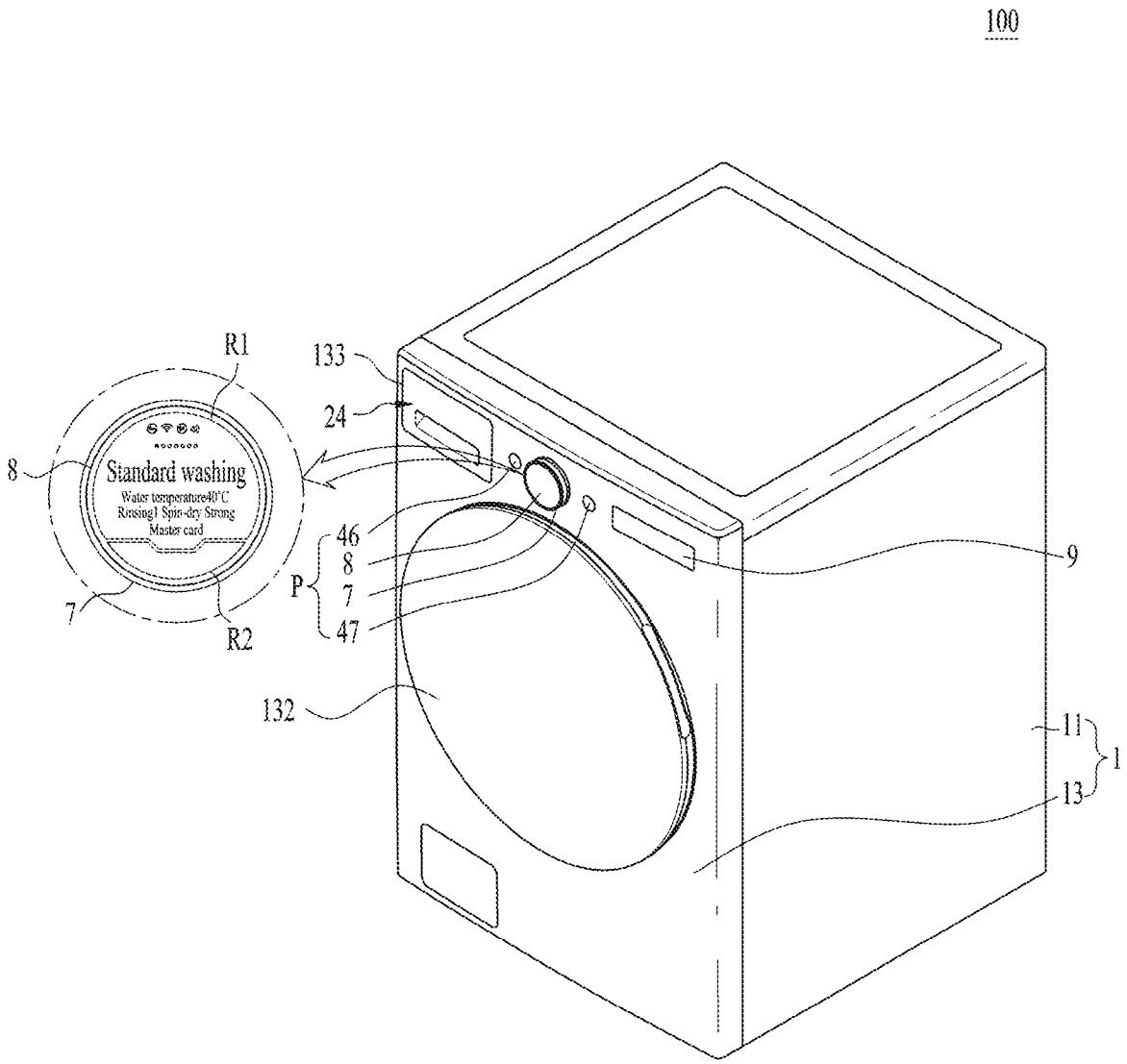
FIGS. 1 and 2 illustrate an example of a laundry treatment apparatus.

As shown in FIG. 1, a laundry treatment apparatus 100 may include a cabinet 1, and an interface P provided in the cabinet 1. The interface P described in the present disclosure refers to a device or program that enables communication between a user and the laundry treatment apparatus (including other electronic devices). The communication between the user and the laundry treatment apparatus refers to the operation of the user inputting control instructions to the laundry treatment apparatus and the operation of the laundry treatment apparatus delivering information to the user.

The cabinet 1 may include a cabinet body 11 having one open side, and a panel (or mounting panel) 13 fixed to the open side of the cabinet body. FIG. 1 illustrates a case where the mounting panel 13 is fixed to the front side of the cabinet body 11 to define the front face of the laundry treatment apparatus.

Figure 2:
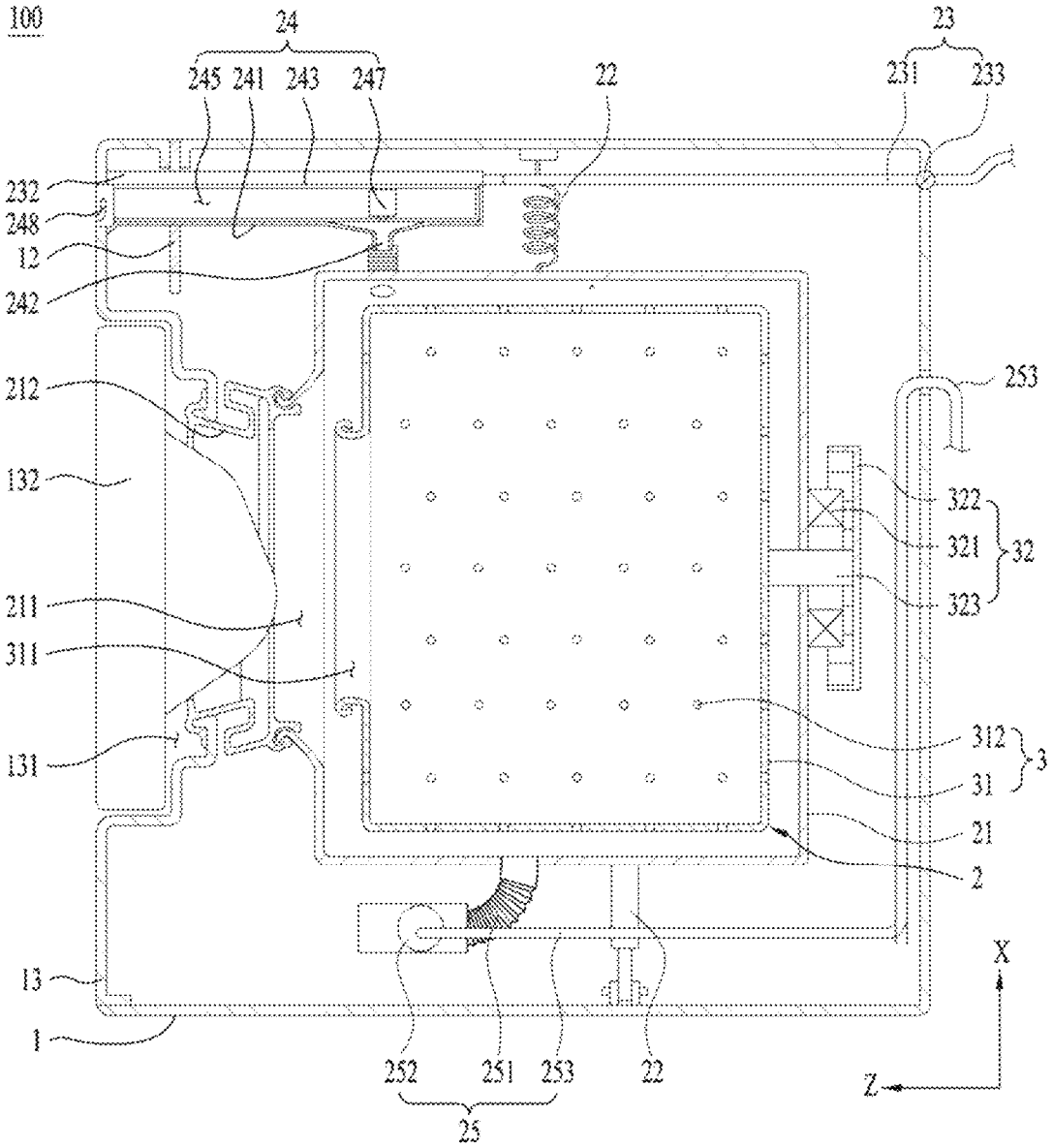

As shown in FIG. 2, the mounting panel 13 is provided with a panel inlet 131 allowing the interior and exterior of the cabinet 1 to communicate with each other. The panel inlet 131 is arranged to be closed by a door 132 rotatably fixed to the cabinet 1.

A tub 2 providing a space to store water and a drum 3 rotatably disposed inside the tub to provide a space to accommodate clothing (collectively referred to as laundry objects) are arranged inside the cabinet 1.

The tub 2 may include a tub body 21 having the shape of a hollow cylinder. The tub body 21 may be fixed inside the cabinet 1 by a tub support 22. FIG. 2 illustrates a case where the tub support 22 includes a spring (connecting the upper space of the tub body to the cabinet) and a damper (connecting the lower space of the tub body to the cabinet).

A tub inlet 211 is provided on a side of the space in the tub body 21 that faces the panel inlet 131. The panel inlet 131 and the tub inlet 211 are connected through a gasket 212. The gasket 212 is provided as an elastic member such as rubber. It is a means to prevent water inside the tub body 21 from being discharged into the cabinet 1 and to minimize transmission of vibration of the tub body 21 to the cabinet 1.

The tub body 21 is supplied with water via a water supply part 23, and water stored in the tub body 21 may be discharged from the cabinet 1 through a drainage part 25.

The drainage part 25 may include a pump 252 disposed at a position lower than that of the tub body 21, a first drainage pipe 251 connecting the tub body 21 to the pump 252, and a second drainage pipe 253 directing water discharged from the pump 252 to the outside of the cabinet.

The water supply part 23 may include a water supply pipe 231 connecting the tub body 21 to a water source located outside of the cabinet, and a water supply valve 233 configured to control opening and closing of the water supply pipe 231.

As shown in the figure, the laundry treatment apparatus 100 may further include a detergent supply part 24.

Figure 3:
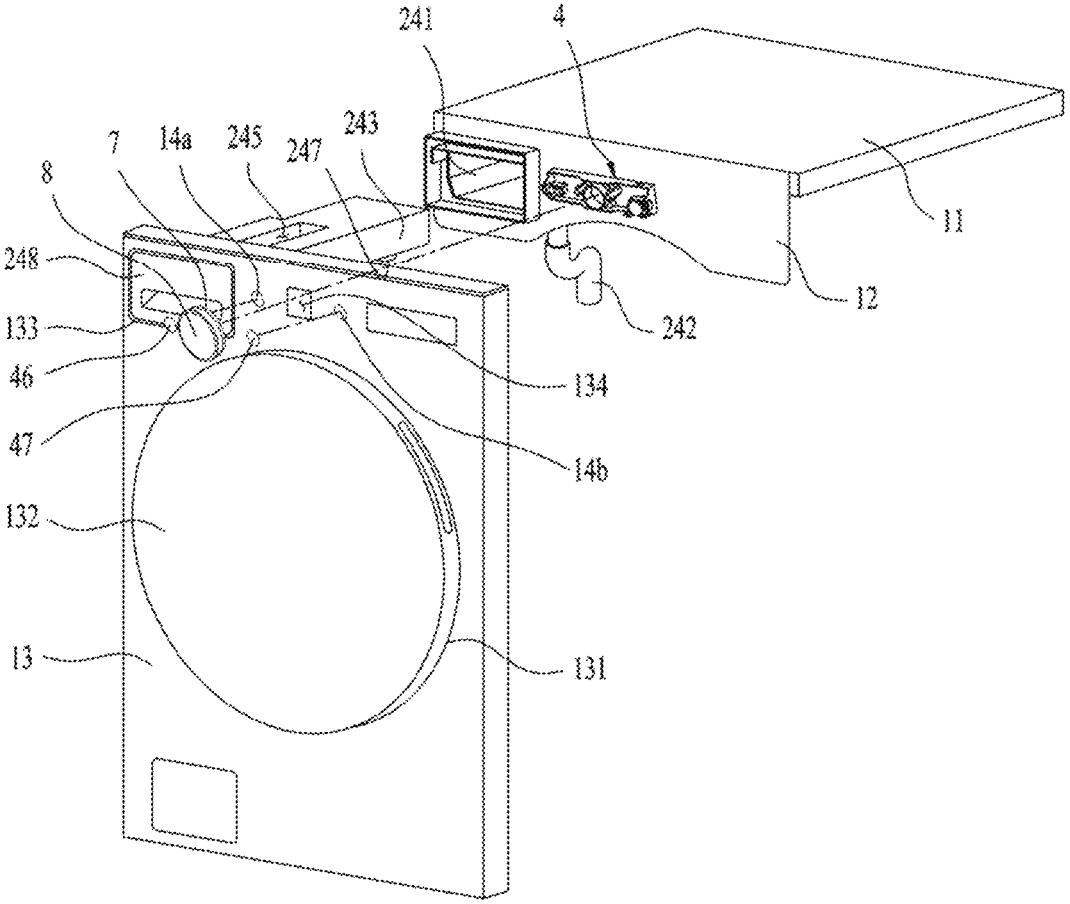
FIGS. 3 and 4 are views illustrating an example of a coupling structure of a cabinet and an interface.

As shown in FIG. 3, the detergent supply part 24 may include a drawer housing 241 arranged inside the cabinet 1, a connection pipe 242 connecting the drawer housing to the tub body 21, and a drawer 243 withdrawable from the drawer housing 241 through a drawer inlet 133 provided in the mounting panel 13.

The drawer 243 may include a chamber 245 providing a space to store detergent, and a discharge channel 247 along which the detergent in the chamber is discharged to the drawer housing 241. The discharge channel 247 may be provided with a water trap (siphon channel, etc.) to move liquid into the drawer housing 241 when the level of liquid stored in the chamber 245 exceeds a preset level.

When the detergent supply part 24 is arranged in the laundry treatment apparatus 100, the water supply part 23 may further include a nozzle 232 through which water is supplied to the chamber 245. The nozzle 232 may be fixed to the cabinet 1 so as to define a top surface of the drawer housing 241, and the water supply pipe 231 may be arranged to connect the nozzle 232 to a water supply source.

The front surface of the drawer 243 may be provided with a drawer panel 248. The drawer panel 248 may be shaped to close the drawer inlet 133. Also, the drawer panel 248 may be provided with a drawer handle.

As shown in FIG. 2, the drum 3 may include a drum body 31 of a cylindrical shape disposed inside the tub body 21, and a drive part 32 configured to rotatably fix the drum body 31 to the tub body 21.

A drum inlet 311 is provided on a side of the space in the drum body 31 that faces the tub inlet 211. Thus, clothing may be introduced into the drum body 31 through the panel inlet 131, the tub inlet 211, and the drum inlet 311.

The drum body 31 is provided with drum through-holes 312 allowing the inside of the drum body to communicate with the outside therethrough. The drum through-holes 312 may be provided in a circumferential surface, a front surface (the surface surrounding the drum inlet), and a rear surface of the drum body 31, respectively. Thus, water or detergent supplied into the tub body 21 may be supplied into the drum body 31 through the drum through-holes 312.

The drive part 32 may include a stator 321 fixed to a rear surface of the tub body 21 and forming a rotating magnetic field, a rotor 322 rotated by the rotating magnetic field, and a rotation shaft 323 extending through the rear surface of the tub body 21 to connect the drum body 31 and the rotor 322.

Figure 4:
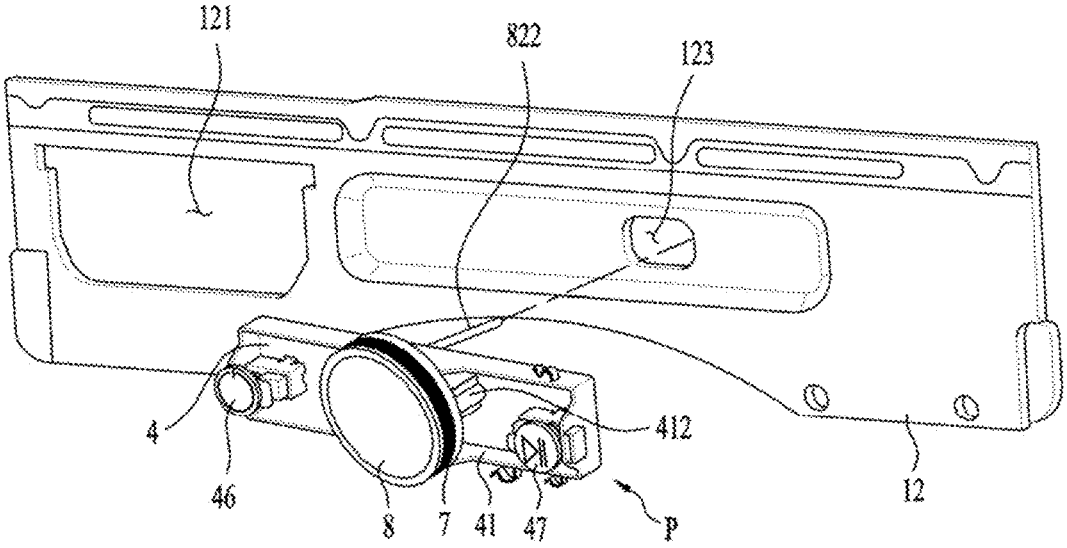

As shown in FIG. 3, the mounting panel 13 may be fixed to the cabinet body 11 by a panel support 12. That is, the panel support 12 may be fixed to the cabinet body 11, and the mounting panel 13 may be fixed to the panel support 12. In this case, as shown in FIG. 4, the panel support 12 may be provided with a drawer through-hole 121 through which the drawer 243 passes.

The interface P may be fixed in an interface mounting groove provided in the panel support 12, or may be fixed to the mounting panel 13 so as to be positioned in the interface mounting groove.

Figure 5:
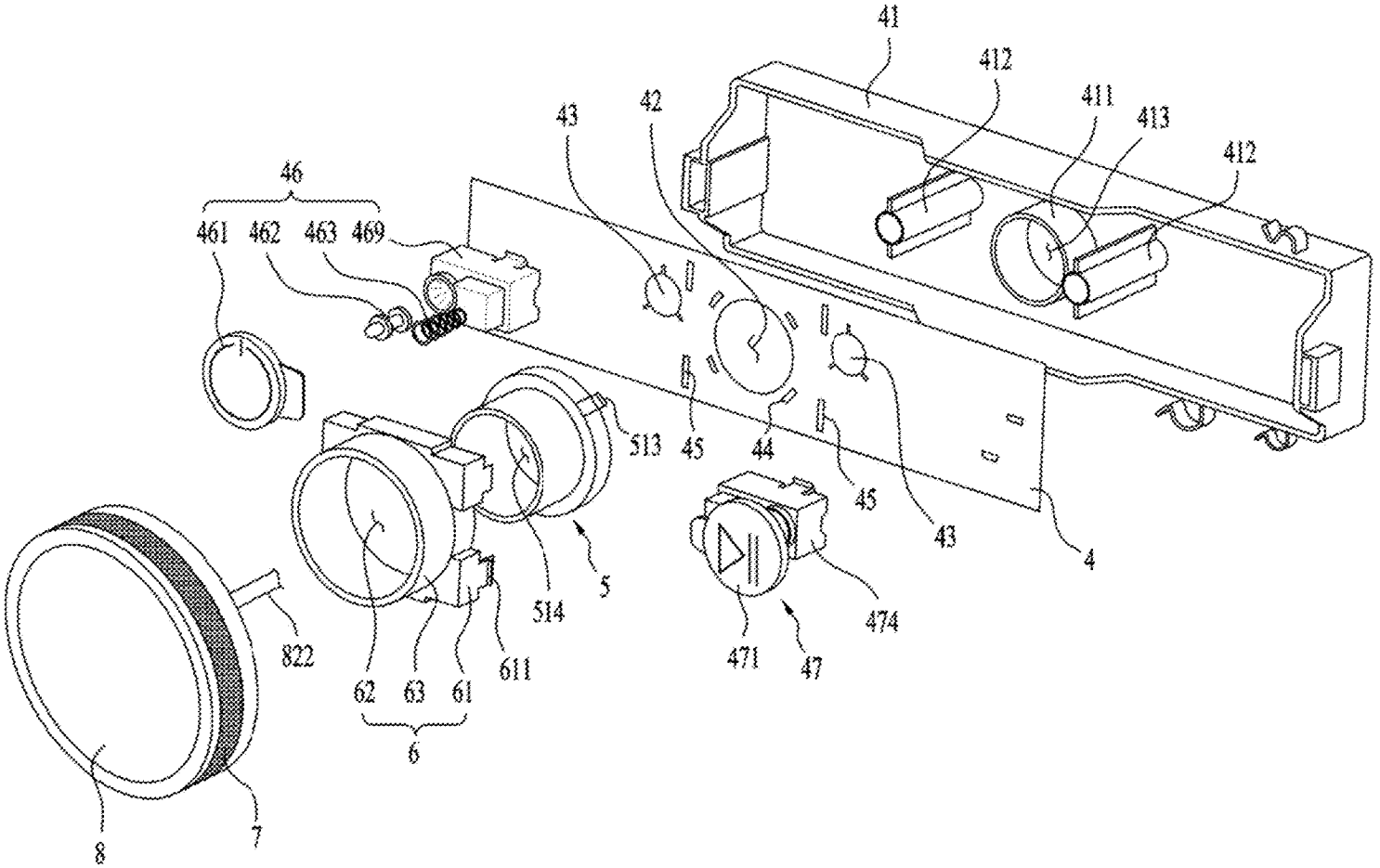
FIG. 5 illustrates a structure of an interface.

As shown in FIG. 5, the interface P may include a circuit board (first circuit board) 4 disposed inside the cabinet 1, an encoder 5 fixed to the circuit board and disposed inside the cabinet 1, an actuator 7 connected to the encoder 5 through the mounting panel 13, and an display part 8 fixed to the encoder 5 or the first circuit board 4 through the mounting panel 13.

The first circuit board 4 is a substrate on which control circuits necessary for the control (power control or operation control) of at least one of the drive unit 32, the water supply valve 233 and the pump 252 are arranged, and may be fixed to the mounting panel 13 or the panel support 12 through a case 41.

The case 41 may have any shape as long as it allows the first circuit board 4 to be fixed to the mounting panel 13 or the panel support 12. FIG. 5 illustrates an example of the case 41 formed in the shape of a hexahedron with one side (the side facing the panel support) open.

The case 41 may be provided with a boss for positioning the first circuit board 4. FIG. 5 illustrates an example case where the boss includes a first boss 411 and a second boss 412. In this case, the first circuit board 4 may include a board through-hole 42 through which the first boss 411 is arranged, and a boss insertion hole 43 through which the second boss 412 is arranged. The second boss 412 may be disposed in the space on both left and right sides of the first boss 411, or may be disposed in the space on both top and bottom sides of the first boss 411.

The display part 8 is connected to a wire 822. The wire 822 may be configured as a power line to supply power to the display part, or may be configured as a communication line to allow the display part 8 to communicate with devices inside the cabinet, including the first circuit board 4.

The first boss 411 may be provided with a first boss through-hole 413, and the panel support 12 may be provided with a wire passing hole 123 (see FIG. 4). In this case, the wire 822 may extend into the cabinet 1 as it is inserted into the first boss through-hole 413 and the wire passing hole 123.

The first circuit board 4 may further include a first input unit 46 and a second input unit 47. The first input unit 46 may be configured to input a control instruction requesting power supply to the laundry treatment apparatus 100, and the second input unit 47 may be configured to input an instruction requesting execution of the control instruction indicated on the display part 8, or an instruction requesting temporary suspension of the control instruction being executed by the laundry treatment apparatus 100.

The first input unit 46 and the second input unit 47 may be configured to generate a control signal by sensing static electricity of the user's body.

In this case, the first circuit board 4 may be configured to receive a touch signal generated when the user's body comes into contact with the first input unit 46 or the second input unit 47.

The first input unit 46 may include a first button 461 exposed to the outside of the cabinet 1, a first sensor 464 fixed to the first circuit board 4, and a conductor (first touch spring) 463 connecting the first button and the first sensor. Similarly, the second input unit 47 may include a second button 471 exposed to the outside of the cabinet 1, a second sensing sensor 474 fixed to the first circuit board 4, and a conductor (second touch spring) (not shown) connecting the second button and the second sensing sensor.

As shown in FIG. 3, the mounting panel 13 may include a first button mounting portion 14*a* and a second button mounting portion 14*b*. The first button 461 may be exposed to the outside of the cabinet 1 through the first button mounting portion 14*a*, and the second button 471 may be exposed to the outside of the cabinet 1 through the second button mounting portion 14*b*.

The first input unit 46 and the second input unit 47 may be disposed in the spaces on the left and right sides of the display part 8, respectively, or may be disposed in the spaces on the top and bottom sides of the display part 8, respectively. Alternatively, they may be vertically or horizontally arranged in the space on the left or right side of the display part 8.

As shown in FIG. 5, the first button conductor 463 and the second button conductor may be provided in the form of a coil, in order to provide resilience to the first button 461 and the second button 471. Further, in order to prevent the first button 461 and second button 471 from being separated from the button mounting portions 14*a* and 14*b*, the first input unit 46 may be provided with a first stopper 462 to limit the range of motion of the first button, and the second input unit 47 may be provided with a second stopper (not shown) to limit the range of motion of the second button.

The encoder 5 is configured to rotatably secure the actuator 7 to the first circuit board 4 and to generate an electrical signal upon rotation of the actuator 7 (or generate an electrical signal set differently according to a rotation angle of the actuator).

Figure 6:
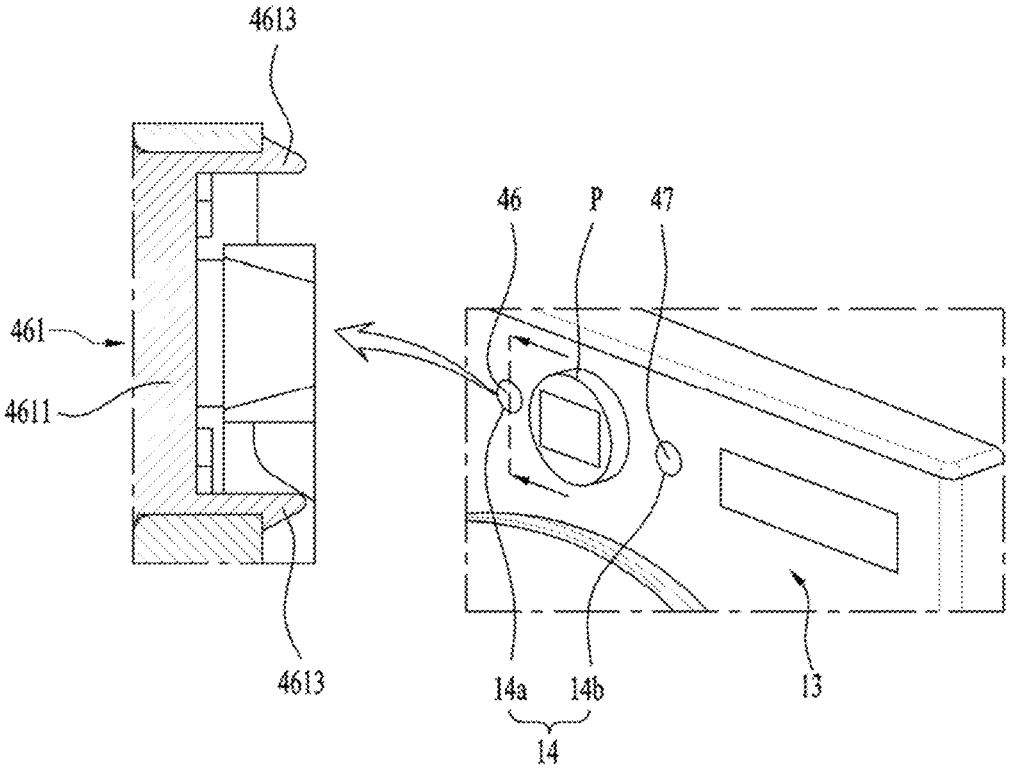
FIG. 6 is a perspective view and a cross-sectional view illustrating a button mounted on a mounting panel.

FIG. 6 illustrates mounting of a button on a mounting panel and shows a cross-sectional view of the button.

Referring to FIG. 6, the first input unit 46 and the second input unit 47 may be disposed to face each other with respect to the interface P. In addition, the first button mounting portion 14*a* and the second button mounting portion 14*b* may be disposed to face each other with respect to the interface P.

Hereinafter, the first input unit 46 and the first button mounting portion 14*a* will be described or illustrated in detail. Hereinafter, in the present disclosure, the first button mounting portion 14*a* will be referred to as a button mounting portion 14. However, details applied to the first button mounting portion 14*a* may be equally applied to the second button mounting portion 14*b*.

In addition, in the present disclosure, the first button 461 will be referred to as a button 461. However, details applied to the first button 461 may be equally applied to the second button 471. That is, although not shown in the drawings, the specific details described in relation to the first button 461 may be equally applied to the second button 471.

Similarly, details described in relation to the first input unit 46 may be equally applied to the second input unit 47.

The laundry treatment apparatus according to an embodiment of the present disclosure may include a button 461 coupled to the mounting panel 13. The button 461 may be arranged to be exposed to the outside of the cabinet 1. The button 461 may be arranged to allow a user to contact the button.

Specifically, the button 461 may include a button body 4611 disposed on the button mounting portion 14. The button body 4611 may be arranged to be exposed to the outside of the cabinet 1 to allow the user's body to contact the button body.

The button 461 may also include a button coupling body 4613 supporting the button body 4611. The button coupling body 4613 may extend from the button body 4611 to a side facing the position of the drum 3. That is, the button coupling body 4613 may extend from the button body 4611 toward the inside of the cabinet 1.

The button coupling body 4613 may be coupled to the button mounting portion 14 to support the button body 4611 to be positioned on the button mounting portion 14. The button coupling body 4613 may be integrated with the button body 4611.

Specifically, the button coupling body 4613 may be disposed inside the cabinet 1 to restrict the movement of the button body 4611 in a direction away from the drum 3. That is, the button 461 may be prevented from being separated from the button mounting portion 14 to the outside of the cabinet 1.

Figure 7:
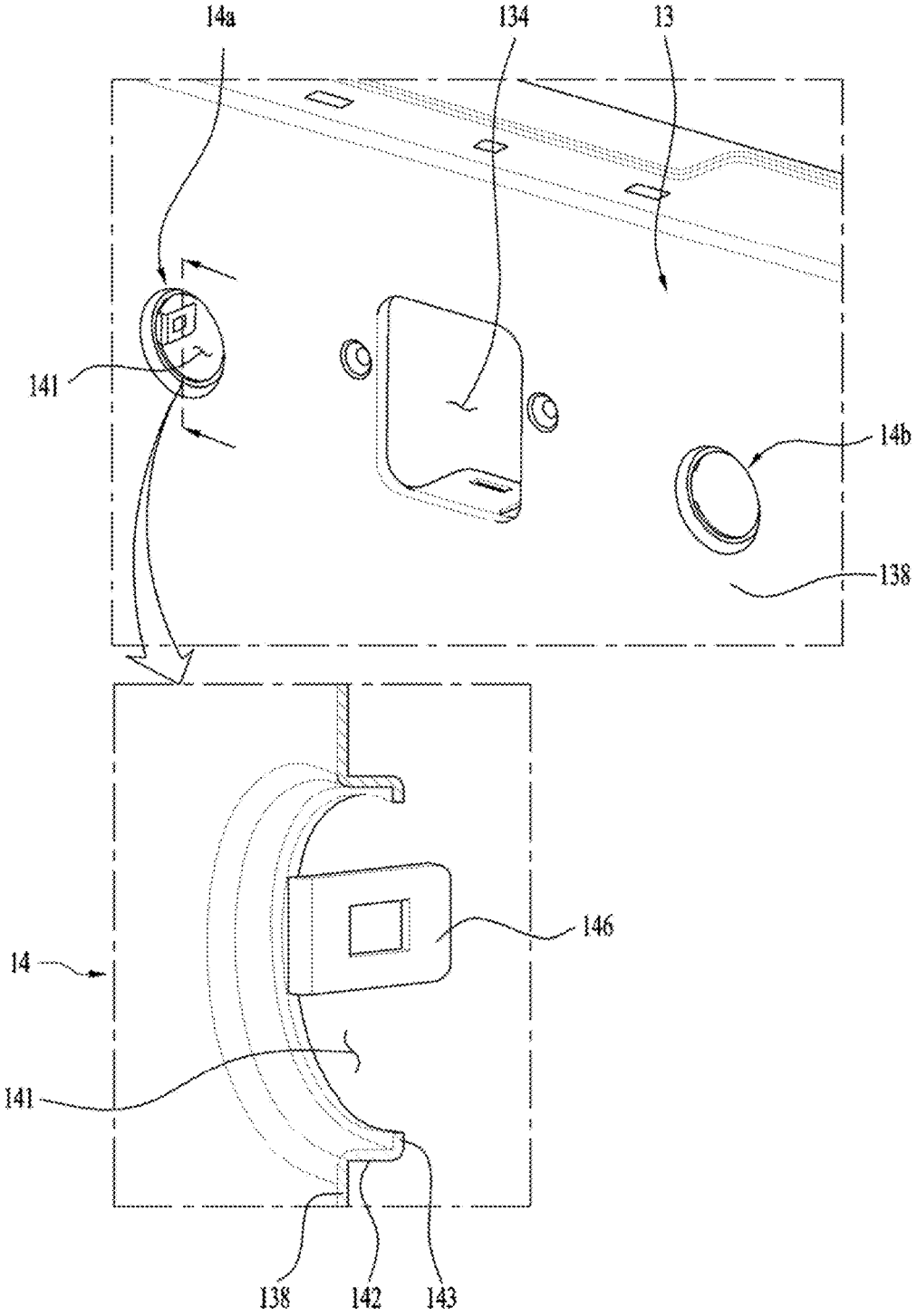
FIGS. 7 and 8 are views illustrating a mounting panel having a button mounting portion, seen in different directions.

FIG. 7 is a view of a mounting panel having a button mounting portion and a cross-sectional perspective view of the button mounting portion, seen from the outside of the cabinet.

Figure 8:
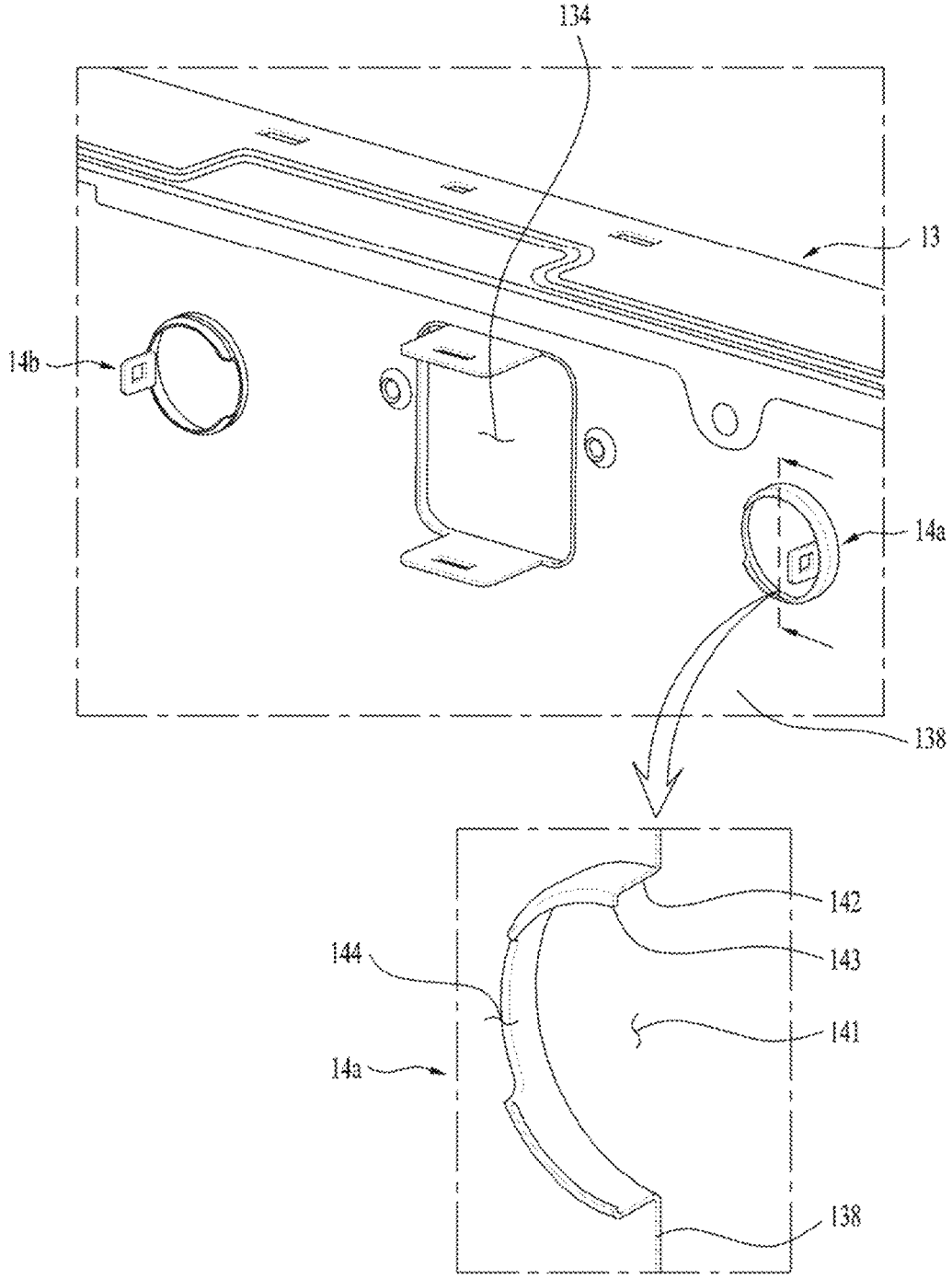

FIG. 8 is a view of the mounting panel having the button mounting portion and a cross-sectional perspective view of the button mounting portion, seen from the inside of the cabinet.

Referring to FIGS. 7 and 8, the button mounting portion 14 may include a button mounting hole 141 formed through the mounting panel 13 in a penetrating manner. Here, the button mounting portion 14 refers to the first button mounting portion 14*a*. However, details described in relation to the button mounting portion 14 may be equally applied to the second button mounting portion 14*b*.

The button mounting hole 141 may be formed in a penetrating manner through one surface of the mounting panel 13 in which the panel inlet 131 is formed. The one surface of the mounting panel 13 in which the panel inlet 131 is formed may be defined as a mounting plate 138. That is, the button mounting hole 141 may be formed through the mounting plate 138 in a penetrating manner.

The button mounting portion 14 may further include a button accommodation rib 142 extending from an edge of the button mounting hole 141 toward the position of the drum 3. Specifically, the button accommodation rib 142 may extend from an edge of the button mounting hole 141 toward the inside of the cabinet 1. The button accommodation rib 142 may be disposed along the circumference of the button 461. That is, the button accommodation rib 142 may define a space in which the button 461 is disposed.

In addition, the button mounting portion 14 may include a button seating rib 143 extending from the button accommodation rib 142 toward the button mounting hole 141. Specifically, when the button mounting hole 141 is formed in a circular shape, the button seating rib 143 may extend radially inward from the inner circumferential surface of the button accommodation rib 142.

The button accommodation rib 142 and the button seating rib 143 may define a space in which the button 461 is accommodated. The button seating rib 143 may extend from the button accommodation rib 142 by a predetermined distance to form a hole communicating with the button mounting hole 141. That is, the button seating rib 143 may extend from the button accommodation rib 142 by a length that does not close the button mounting hole 141.

The button mounting portion 14 may further include a rib cut-open portion formed by cutting away a part of the button accommodation rib 142 and the button seating rib 143. The rib cut-open portion 144 may be recessed from the button accommodation rib 142 and the button seating rib 143, which are formed in a pipe shape. In other words, the rib cut-open portion 144 may be such that a portion of the button accommodation rib 142 and the button seating rib 143 are removed.

More specifically, the rib cut-open portion 144 may be formed by recessing a portion of the button accommodation rib 142, and a portion of the button seating rib 143 corresponding to the recessed portion of the button accommodation rib 142 may be cut away.

The rib cut-open portion 144 may provide a space in which a portion of the button 461 is seated. In addition, the rib cut-open portion 144 may be formed only in a portion of the circumference of the button accommodation rib 142 and the button seating rib 143. For example, when the button accommodation rib 142 and the button seating rib 143 are formed in a pipe shape, the rib cut-open portion 144 may be provided in a region that does not exceed 40 percentage of the circumference of the button accommodation rib 142 and the button seating rib 143.

As will be described later, in coupling the button 461 to the button mounting portion 14, the rib cut-open portion 144 may serve to guide the user to intuitively perform the assembly operation without confusing the assembly direction.

The button mounting portion 14 may further include a case mounting portion 146 supporting the case 41. The case mounting portion 146 may extend from the mounting panel 13 toward the position of the drum 3. The case mounting portion 146 may extend from the button accommodation rib 142 toward the position of the drum 3. In addition, the case mounting portion 146 may extend from the button seating rib 143 toward the position of the drum 3. The case mounting portion 146 may be disposed to face the rib cut-open portion 144. The case mounting portion 146 will be described in detail later.

Figure 9:
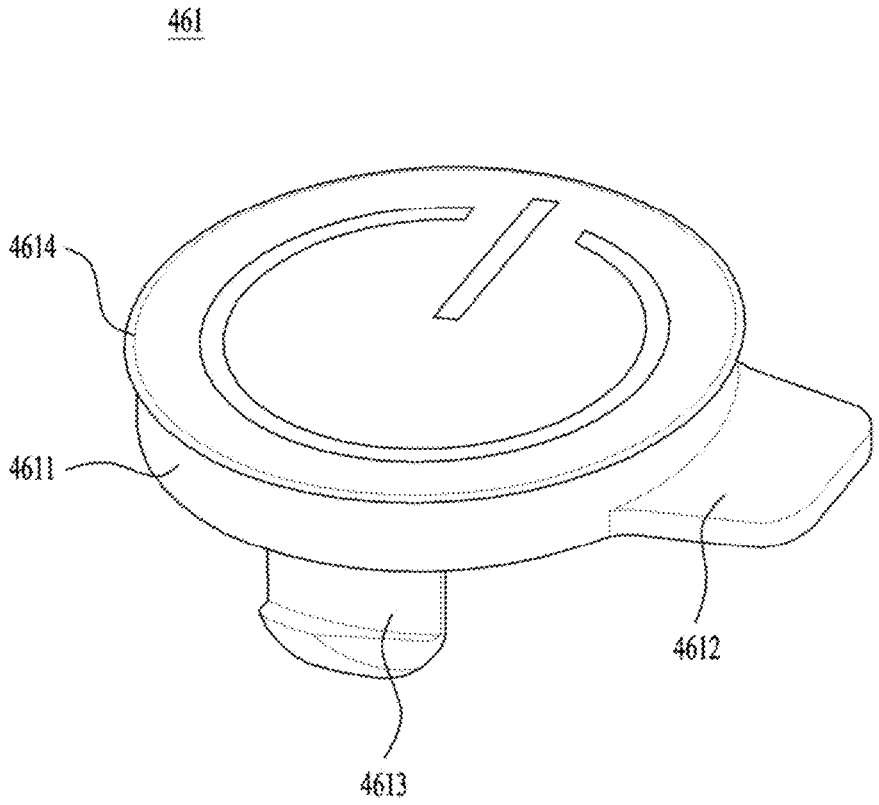
FIG. 9 illustrates a button according to an embodiment of the present disclosure.

FIG. 9 illustrates a button according to an embodiment of the present disclosure.

Referring to FIG. 9, the button 461 may include a button body 4611 disposed on the button mounting portion 14 to allow the user's body to contact the button body, a button extension body 4612 extending from an edge of the button body 4611 and disposed inside the cabinet 1, and a button coupling body 4613 extending from the button body 4611 to fix the button body 4611 to the mounting panel 13.

The button body 4611 may have a cylindrical shape. Specifically, it may be formed in the shape of a coin whose height is less than the radius of the coin. In addition, a pattern may be engraved on a surface of the button body 4611 that is exposed to the outside of the cabinet, such that the user can intuitively recognize the function of the button. The figure illustrates that a pattern representing a power button is engraved as an example. As another example, the pattern representing the start/pause may be engraved. However, the present disclosure is not limited to the examples described above, and various patterns may be engraved.

The user may transmit a signal to the first circuit board 4 by touching the button body 4611. In the case where the button body 4611 is formed of a conductive material, a control signal may be transmitted to the first circuit board 4 through the button conductor 463 when the user touches the button body 4611.

In the case where the button body 4611 is formed of a non-conductive material, a button touch film 4617 (see FIG. 15) capable of recognizing whether the user's body is in contact with one surface of the button body 4611 facing the first circuit board 4 may be fixed to transmit a touch signal to the first circuit board 4.

The button extension body 4612 may extend from an edge of the button body 4611. Specifically, when the button body 4611 is formed in a cylindrical shape as described above, the button extension body 4612 may extend radially outward from the outer circumferential surface of the button body 4611. The button extension body 4612 may be provided only on one side of the edge of the button body 4611. In particular, the button extension body 4612 may extend from one surface of the button body 4611 disposed inside the cabinet 1.

In addition, the button coupling body 4613 may extend from the button body 4611 toward the position of the drum 3. The button coupling body 4613 may be coupled to the button accommodation rib 142 or the button seating rib 143 to support the button body 4611.

The button coupling body 4613 may determine the position of the button body 4611. The button coupling body 4613 may be formed in a hook shape to restrict movement of the button body 4611 from the button mounting portion 14.

The button 461 may further include a button protrusion body 4614 protruding from an edge of the button body 4611. The button protrusion body 4614 may extend from the button body 4611 toward an edge of the button mounting hole 141 so as to be exposed to the outside of the cabinet 1.

The button protrusion body 4614 may extend along the circumference of the button body 4611. The button protrusion body 4614 may extend from the edge of the button body 4611 toward the edge of the button mounting hole 141. The button protrusion body 4614 may shield a space formed between the edge of the button mounting hole 141 and the button body 4611.

The button protrusion body 4614 may prevent foreign substances from being introduced into the space between the edge of the button mounting hole 141 and the button body 4611. Since electronic components including the first circuit board 4 are arranged at the rear of the button body 4611, the electronic components may be damaged when foreign substances such as water are introduced through the button mounting hole 141. Accordingly, the button protrusion body 4614 may block the inflow of foreign substances, thereby improving the reliability and stability of the laundry treatment apparatus.

Figure 10:
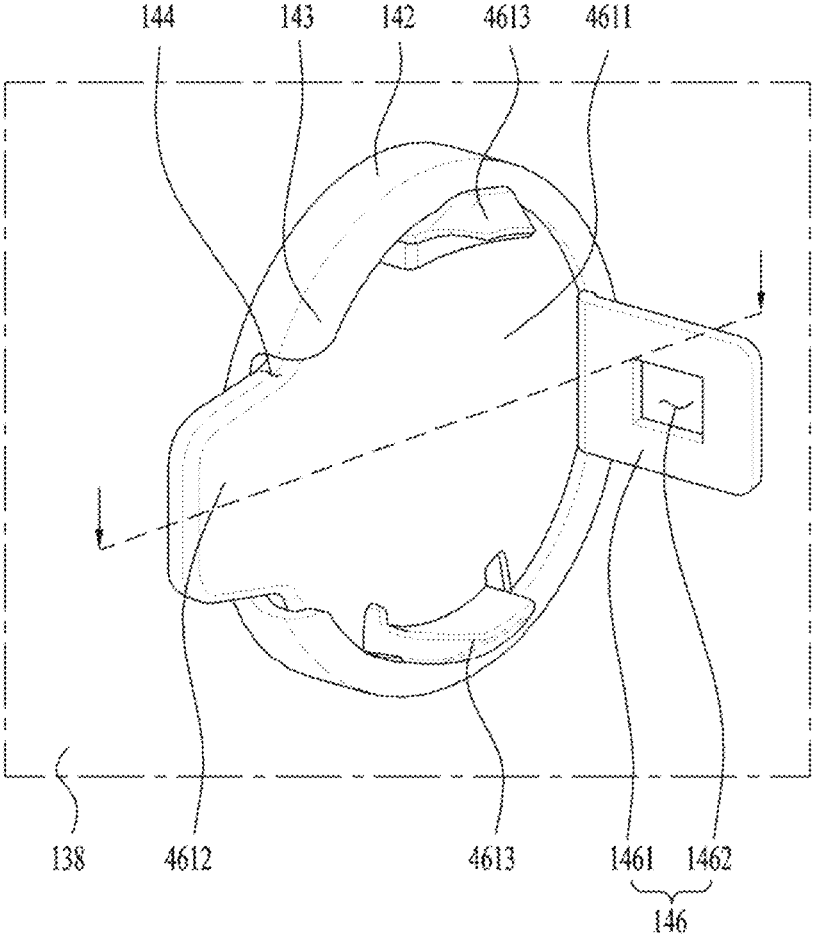
FIG. 10 is a view illustrating coupling between a button and a button mounting portion seen from the inside of the cabinet.

FIG. 10 is a view illustrating coupling between a button and a button mounting portion seen from the inside of the cabinet.

Referring to FIG. 10, the button extension body 4612 may extend from an edge of the button body 4611. In particular, the button extension body 4612 may extend to be parallel to the mounting plate 138. In addition, the button extension body 4612 may form one surface together with the button body 4611. In particular, the one surface may be formed to face the drum. Specifically, the button body 4611 and the button extension body 4612 may form one surface arranged inside the cabinet 1 to be parallel to the mounting plate 138.

In addition, the button extension body 4612 may be disposed in the rib cut-open portion 144. The button extension body 4612 may be seated in the rib cut-open portion 144 to prevent the button body 4611 from rotating. That is, the button extension body 4612 may be positioned in the rib cut-open portion 144 to restrict movement of the button body 4611.

In particular, the button extension body 4612 may be disposed to be in contact with a portion of the button accommodation rib 142 where the rib cut-open portion 144 is formed. In other words, the rib cut-open portion 144 may be provided to determine a position at which the button extension body 4612 is disposed.

Referring back to FIG. 9, a pattern that the user may visually recognize may be engraved or drawn on a surface of the button body 4611 exposed to the outside of the cabinet 1. If the coupling position of the corresponding button 461 is not determined in the assembly process, it may be difficult for the user to accurately recognize the pattern. In this regard, the rib cut-open portion 144 may determine the position of the button extension body 4612 to determine the arrangement of the button 461. In other words, when the button extension body 4612 is disposed in the rib cut-open portion 144, the pattern may be positioned correctly and thus be easily recognized by the user.

That is, in the process of assembling the button, the button may be coupled in correct position when the operator simply positions the button extension body 4612 in the rib cut-open portion 144 without considering the position of the pattern. Therefore, the assemblability of the button 461 may be improved. In particular, once the button 461 is coupled to the button mounting portion 14, the button 461 may be prevented from rotating to displace the pattern engraved on the button 461.

The button coupling body 4613 may be coupled to the button seating rib 143. The button coupling body 4613 may be engaged with a surface of the button seating rib 143 facing the drum 3. That is, the button coupling body 4613 may be hook-coupled to the button seating rib 143.

Specifically, the button coupling body 4613 may restrict the button body 4611 from moving to the outside of the cabinet 1. In particular, the button coupling body 4613 may be provided to restrict the button body 4611 from moving in a direction away from the button seating rib 143.

That is, the button body 4611 may be prevented from moving into the cabinet 1 by the button seating rib 143, and may be prevented from moving to the outside of the cabinet 1 by the button coupling body 4613. Accordingly, the position of the button body 4611 in the button mounting portion 14 may be determined by the button seating rib 143 and the button coupling body 4613.

The button coupling body 4613 may be elastically deformable while being coupled to the button seating rib 143. Accordingly, when the button body 4611 is inserted into the button mounting hole 141 by a predetermined distance in a direction away from the button seating rib 143 and then the coupling is completed, the button coupling body 4613 may be elastically deformed to be coupled to the button seating rib 143. That is, while the button body 4611 is inserted into the button mounting hole 141, the button coupling body 4613 may be elastically deformed toward the center of the button body 4611.

Once the coupling of the button 461 is completed, the button accommodation rib 142 may be positioned along the edge of the button body 4611, and the button seating rib 143 may support one side of the button body 4611. The button seating rib 143 may support one surface of the button body 4611 facing the drum.

The mounting panel 13 may include a case mounting portion 146 to which the case 41 (see FIG. 5) is coupled. The button mounting portion 14 may include the case mounting portion 146 extending from the button accommodation rib 142 or the button seating rib 143. The case mounting portion 146 may extend from the mounting plate 138. The case mounting portion 146 may support the case 41 to be positioned inside the cabinet 1.

The case mounting portion 146 may include a mounting extension body 1461 extending from the button accommodation rib 142 or the button seating rib 143 toward the position of the drum 3, and a mounting fastening hole 1462 formed through the mounting extension body 1461 in a penetrating manner. In addition, the mounting extension body 1461 may extend from the mounting plate 138 toward the position of the drum 3.

A portion of the case 41 may be inserted into the mounting fastening hole 1462 to be supported by the mounting extension body 1461. The case 41 may be directly coupled to the mounting panel 13 through the case mounting portion 146. Accordingly, the first circuit board 4 installed in the case 41 may also be disposed inside the cabinet 1.

Figure 11:
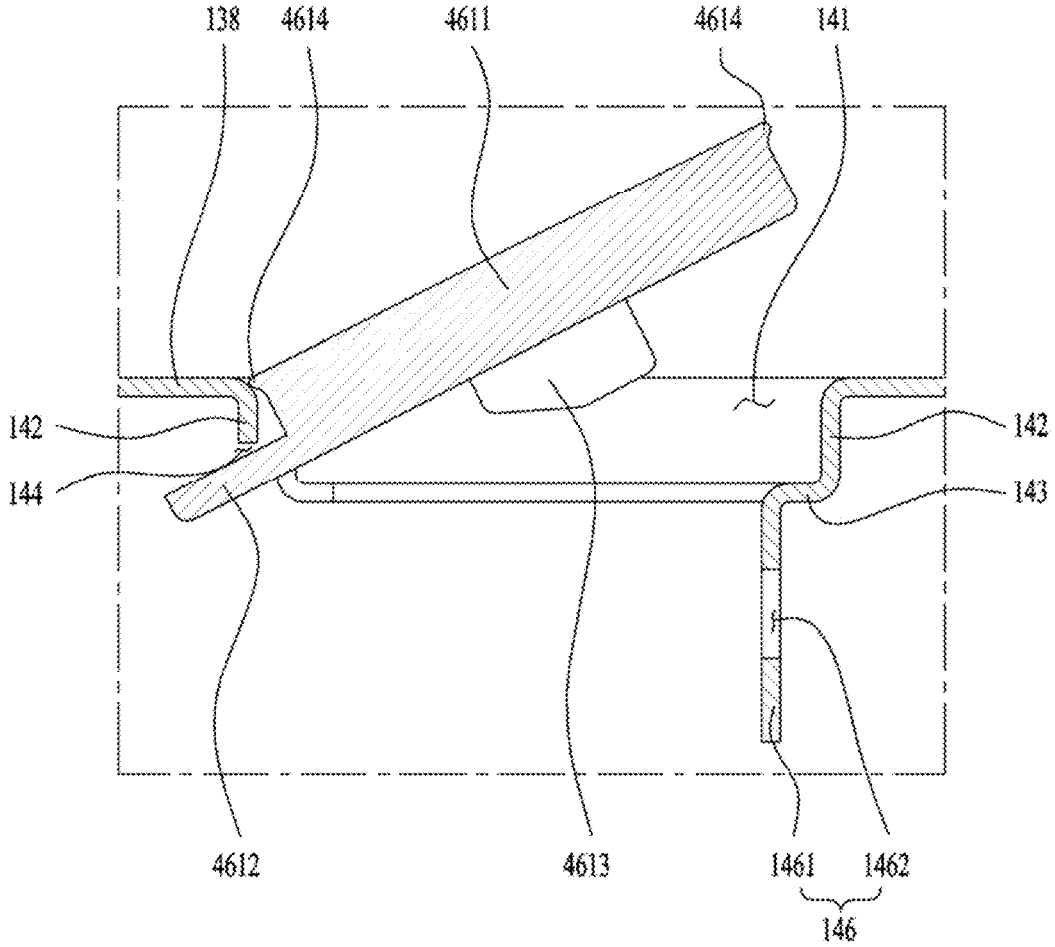
FIG. 11 is a view illustrating a process in which a button according to an embodiment of the present disclosure is coupled to a button mounting portion.
Figure 12:
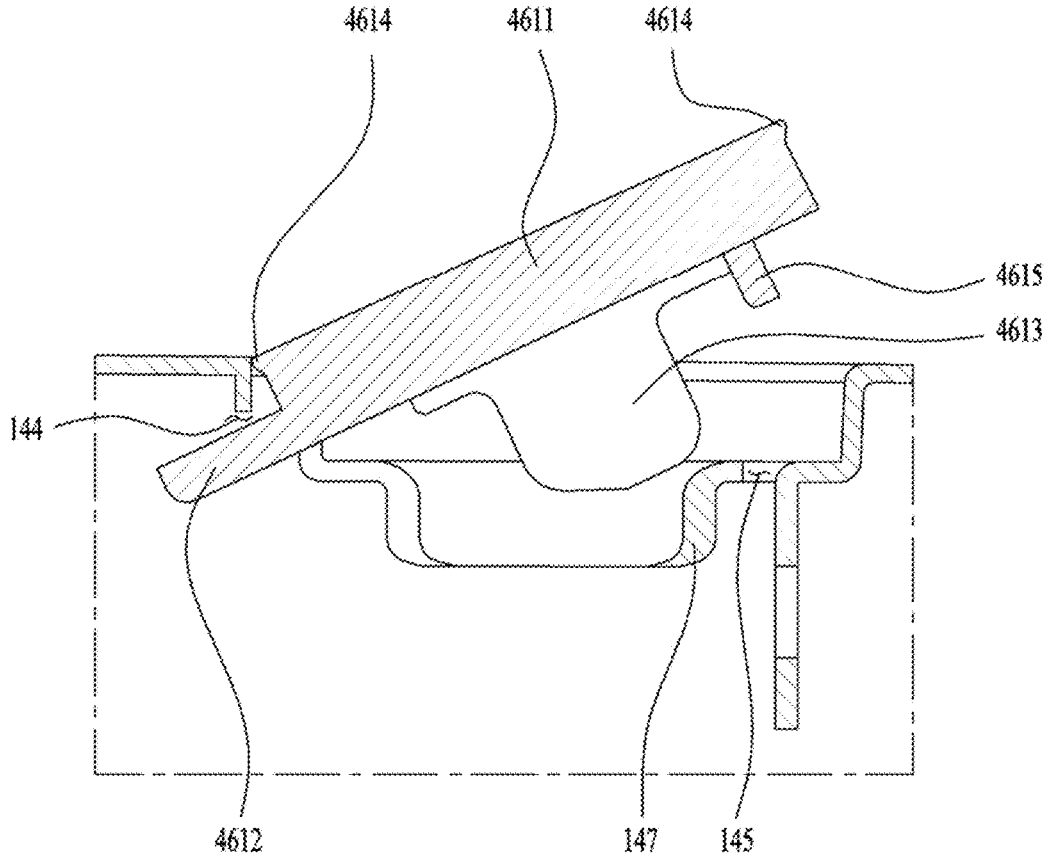
FIG. 12 is a view illustrating a process in which a button according to another embodiment of the present disclosure is coupled to the button mounting portion.

FIG. 11 is a view illustrating a process in which a button according to an embodiment of the present disclosure is coupled to a button mounting portion. FIG. 12 is a view illustrating a process in which a button according to another embodiment of the present disclosure is coupled to the button mounting portion.

Referring to FIGS. 11 and 12, when the button 461 is coupled to the button mounting portion 14, the button extension body 4612 may be first positioned in the rib cut-open portion, and then the button body 4611 may be rotated and coupled in a direction from the outside of the cabinet 1 toward the button seating rib 143.

That is, after the mounting position of the button 461 is determined using the button extension body 4612 and the rib cut-open portion 144, the button body 4611 may be pressed inward from the outside of the cabinet 1 to be coupled to the button mounting portion 14. Once the button body 4611 is pressed up to the mounting position, the button coupling body 4613 may be coupled to the button seating rib 143.

In other words, the button 461 may be coupled from the outside of the cabinet 1. When the button 461 is coupled as described above, a separate coupling member may not be used to fix the button 461 to the button mounting portion 14. In addition, since the button extension body 4612 and the rib cut-open portion 144 can determine the mounting position of the button, assemblability may be improved.

To couple the button, the operator may simply position the button extension body 4612 in the rib cut-open portion 144 and then press the button body 4611. In addition, the button 461 may be disposed at a correct position through a series of operations.

In addition, since the button 461 is coupled at the front, a space formed between the button 461 and the button mounting portion 14 may be minimized. Accordingly, foreign substances may be prevented from being introduced into the space between the button 461 and the button mounting portion 14. In particular, foreign substances may be prevented from being introduced into the space between the circumference of the button mounting hole 141 and the button 461.

Referring to FIG. 12, according to another embodiment of the present disclosure, the mounting panel 13 may further include a guide groove 145 formed through the button seating rib 143. In other words, the button mounting portion 14 may further include the guide groove 145 formed through the button seating rib 143. The button 461 may further include a button guide protrusion 4615 inserted into the guide groove 145. The button guide protrusion 4615 may protrude from the button body 4611 toward the button seating rib 143.

The button guide protrusion 4615 may determine a mounting position of the button body 4611 together with the button extension body 4612. As described above, a pattern may be engraved on the exposed surface of the button body 4611. The shape of the pattern recognized by the user may depend on the angle at which the button body 4611 is mounted. Accordingly, it may be important to correctly position the button body 4611. The button guide protrusion 4615 may guide the button body 4611 to be arranged at an accurate assembly position.

When the button guide protrusion 4615 is inserted into the guide groove 145, the pattern engraved on the button body 4611 may be exposed to the user in an appropriate state. Accordingly, in coupling the button 461, the operator may not need to care about the position of the button. In particular, once the button guide protrusion 4615 is inserted into the guide groove 145, the operator may recognize that the button has been coupled at an accurate position. Accordingly, the button guide protrusion 4615 and the guide groove 145 may improve assemblability and shorten the time required for assembly. That is, the button guide protrusion 4615 and the guide groove 145 may reduce the assembly cost of the button 461.

A process of coupling the button 461 to the button guide protrusion 4615 is described below. In coupling the button 461, the button extension body 4612 may be positioned in the rib cut-open portion 144. Next, the button body 4611 may be rotated about a contact point between the button extension body 4612 and the button accommodation rib 142 by pressing the button body 4611. As the button body 4611 is positioned adjacent to the button seating rib 143, the button guide protrusion 4615 may be inserted into the guide groove 145.

Once the button extension body 4612 is disposed in the rib cut-open portion 144 and the button guide protrusion 4615 is inserted into the guide groove 145, the button body 4611 may be prevented from rotating in the button mounting hole 141, and thus the position thereof may be determined. That is, assemblability of the button 461 may be improved through the above-described structure.

Next, the button guide protrusion 4615 may be disposed on a side of the button body 4611 facing away from the button extension body 4612. Specifically, the button guide protrusion 4615 may be formed at a position facing the button extension body 4612. That is, the button extension body 4612 and the button guide protrusion 4615 may be spaced apart from each other on a line passing through the center of the button body 4611.

In addition, the guide groove 145 may be provided at a position corresponding to the button guide protrusion 4615. Accordingly, the guide groove 145 may be provided at a position facing the rib cut-open portion 144.

When the arrangement is established as described above, the button extension body 4612 and the button guide protrusion 4615 may support the button body 4611 on both sides, thereby firmly supporting the button body 4611.

The button mounting portion 14 may further include a button coupling rib 147 extending from the button seating rib 143 toward the position of the drum 3. The button coupling rib 147 may be arranged to support the button coupling body 4613. The button accommodation rib 142 and the button coupling rib 147 may be connected to each other to be stepped by the button seating rib 143. When the button coupling rib 147 is provided, the button body 4611 may be supported by the button seating rib 143, and the button coupling body 4613 may be supported by the button coupling rib 147. That is, since the positions on the button mounting portion 14 at which the button body 4611 and the button coupling body 4613 are supported are separated, the button mounting portion 14 may more firmly support the button 461.

The button 461 may further include a button protrusion body 4614 extending from an edge of the button body 4611 to close the button mounting hole 141. The button protrusion body 4614 may be disposed outside the cabinet 1. The button protrusion body 4614 may be positioned farther from the drum than the button extension body 4612.

The button protrusion body 4614 may be provided to close a space formed between the edge of the button mounting hole 141 and the button body 4611. The button protrusion body 4614 may block foreign substances from being introduced into the space between the edge of the button mounting hole 141 and the button body 4611.

The button protrusion body 4614 may extend along an edge of the button body 4611. That is, the button protrusion body 4614 may expand an area of a portion of the button body 4611 exposed to the outside of the cabinet 1.

In addition, the button protrusion body 4614 may extend from the button body 4611 to contact the button accommodation rib 142. The button protrusion body 4614 may contact the button accommodation rib 142 to shield the button mounting hole 141.

The button accommodation rib 142 may have a predetermined curvature at the edge of the button mounting hole 141. That is, the point of connection between the button accommodation rib 142 and the mounting plate 138 may be rounded. In this case, one surface of the button protrusion body 4614 facing the button accommodation rib 142 may have a curvature corresponding to the curvature of the button accommodation rib 142.

The button protrusion body 4614 may protrude longer than the separation distance between the accommodation rib 142 and the button body 4611. In this case, the button protrusion body 4614 may cover the space formed between the accommodation rib 142 and the button body 4611. In addition, the button protrusion body 4614 may prevent the space from being exposed to the outside.

Figure 13:
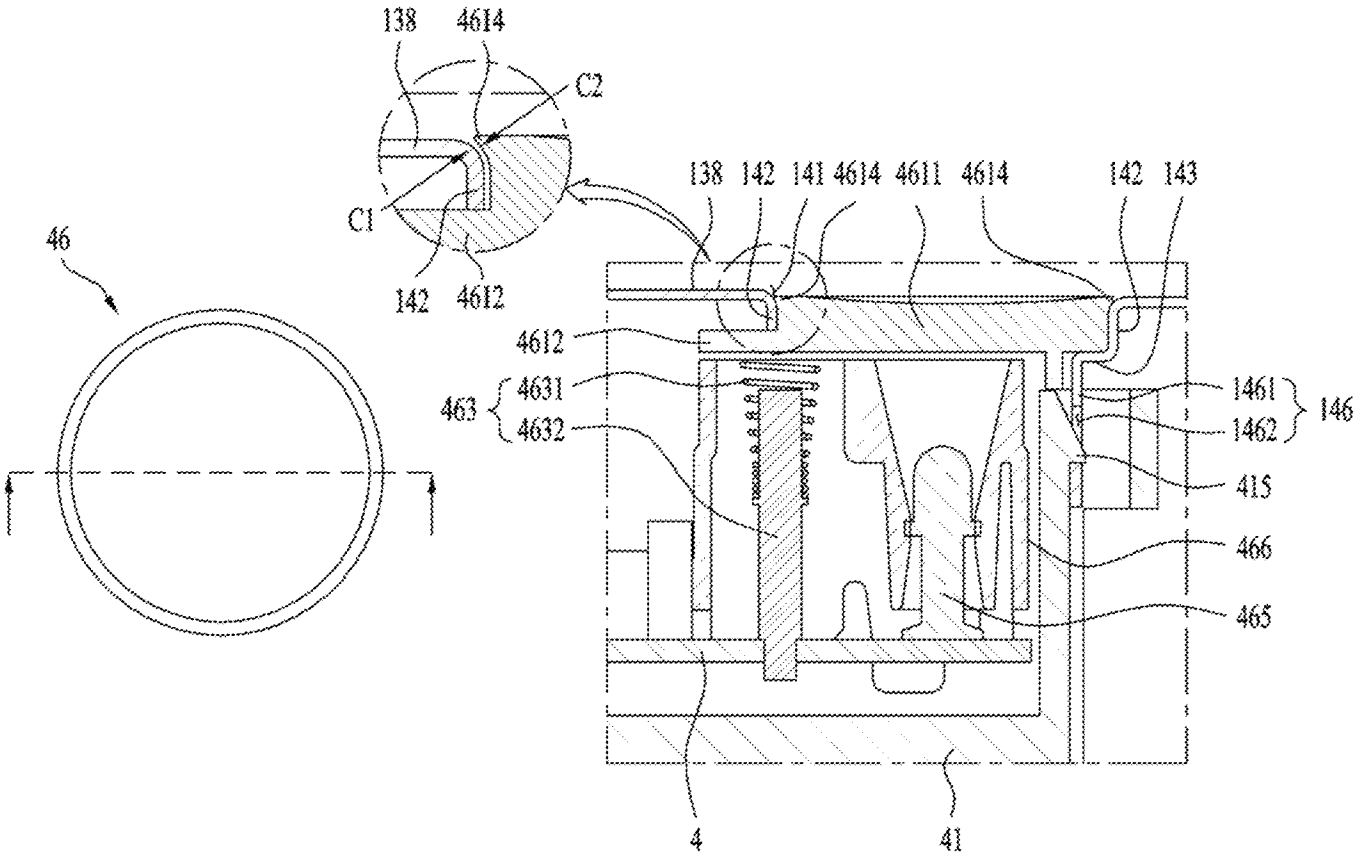
FIG. 13 is a cross-sectional view of a portion on which a button is mounted, taken along a direction parallel to the ground.
Figure 14:
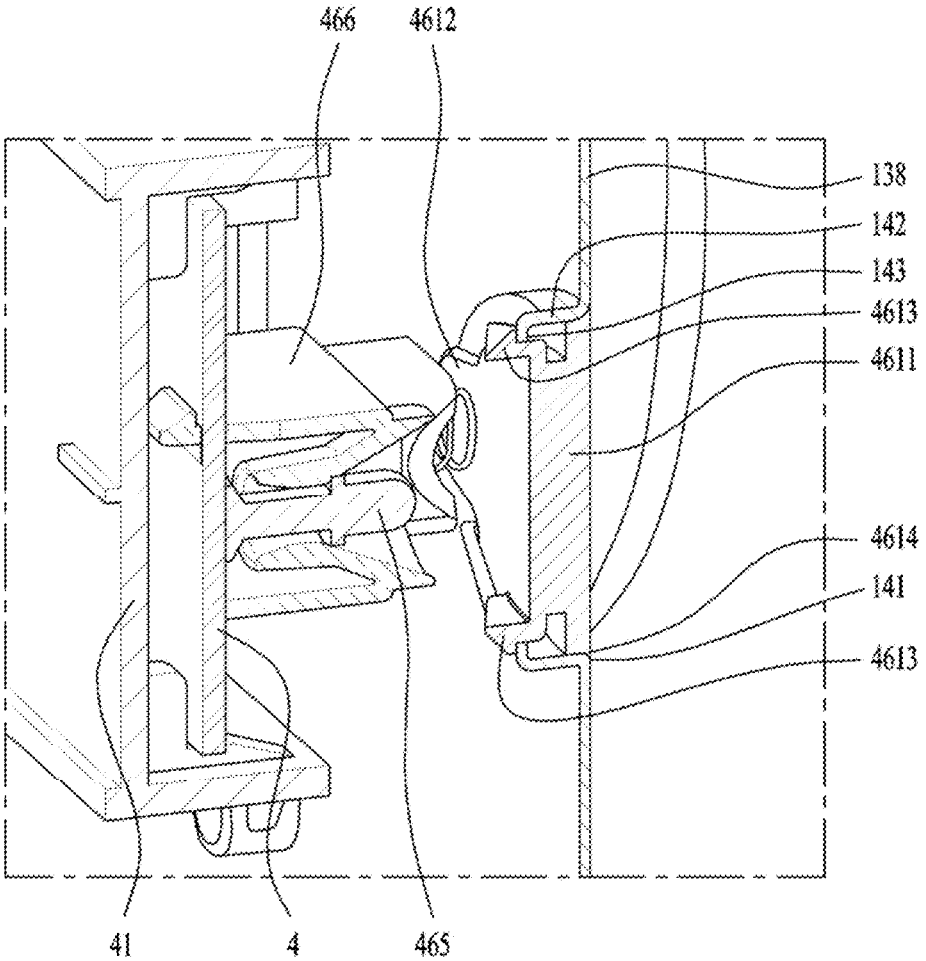
FIG. 14 is a cross-sectional view of a portion on which a button is mounted, taken along a height direction.

FIG. 13 is a cross-sectional view of a portion of the laundry treatment apparatus on which a button is mounted, taken along a direction parallel to the ground. FIG. 14 is a cross-sectional view of a portion of the laundry treatment apparatus on which a button is mounted, taken along a height direction Referring to FIGS. 13 and 14, the button accommodation rib may extend from the mounting plate 138 to have a predetermined curvature C1, and one surface of the button protrusion body 4614 facing the button accommodation rib 142 may have a curvature C2 corresponding to the curvature C1. When the curvatures C1 and C2 are provided to correspond to each other, the button protrusion body 4614 may more effectively close the button mounting hole 141.

In particular, the button protrusion body 4614 may extend from an edge of the button body 4611. It may be provided to extend in a direction away from the drum 3. In other words, the length of the button protrusion body 4614 may increase as it extends extending from the button body 4611 in a direction away from the button extension body 4612.

The first circuit board 4 and the button 461 may be spaced apart from each other. The button conductor 463 may be arranged to connect the button 461 to the first circuit board 4. The button conductor 463 may include a conductive bar 4632 connected to the first circuit board 4, and a spring 4631 connecting the conductive bar 4632 and the button 461. The spring 4631 may be formed of an elastic material to effectively connect the button 461 and the conductive bar 4632.

When the spring 4631 is formed of an elastic material, the spring 4631 may be in close contact with one surface of the button 461 contacting the spring 4631. When the user touches the button body 4611 exposed to the outside of the cabinet 1, the capacitance may be instantaneously changed by the body of the user, and a signal may be transmitted to the first circuit board 4 via the spring 4631 and the conductive bar 4632. The first circuit board 4 may recognize the signal and control the movement of the drum 3. As shown in FIG. 13, the button conductor 463 may be configured as a combination of the conductive bar 4632 and the spring 4631, but is not limited thereto. It may be configured with various elements capable of transmitting a touch signal of the user to the first circuit board 4.

In addition, the case 41 may be coupled to the case mounting portion 146. A portion of the case 41 coupled to the case mounting portion 146 may be provided with a case coupling protrusion 415. The case coupling protrusion 415 may be coupled to the mounting fastening hole 1462. The case 41 may be coupled to the case mounting portion 146 to position the first circuit board 4 inside the cabinet 1.

The first input unit 46 may further include a supporter 466 coupled to the first circuit board 4. The supporter 466 may be coupled to the first circuit board 4 to be positioned between the button 461 and the first circuit board 4. The supporter 466 may provide a space in which the button conductor 463 is positioned. In other words, the supporter 466 may be provided to accommodate the button conductor 463. The supporter 466 may prevent foreign substances from being introduced into the button conductor 463 to prevent the touch signal from being disturbed.

In addition, the first input unit 46 may further include a light emitting member 465 coupled to the first circuit board 4. The light emitting member 465 may be disposed on the button body 4611 and the first circuit board 4. When the light emitting member 465 is turned on, the user may recognize light emitted from the light emitting member 465 through the button body 4611.

As shown in FIG. 9, a pattern may be engraved on the exposed surface of the button body 4611. When the light emitting member 465 is turned on, the user may recognize that light as being emitted from the pattern. Accordingly, the user may more easily recognize the button, and easily recognize that the button is for performing a function according to the pattern engraved on the button. That is, the light emitting member 465 may enhance usage of the button 461. The pattern engraved on the button body 4611 may allow light emitted from the light emitting member 465 to pass therethrough.

The light emitting member 465 may be supported by the supporter 466. The light emitting member 465 may be supported by the supporter 466 and be turned on or off according to a control signal of the first circuit board 4.

The button conductor 463 may be arranged to connect the button extension body 4612 to the first circuit board 4. The light emitting member 465 may be disposed at a portion of the button 461 facing the button body 4611. Accordingly, the button conductor 463 may connect the button 461 to the first circuit board 4 by extending around the light emitting member 465. The button conductor 463 may be arranged to contact the button extension body 4612 to contact the button 461 around the light emitting member 465.

In this case, the button extension body 4612 may expand the area that the button conductor 463 may contact. Accordingly, the button conductor 463 may more smoothly transmit the touch signal of the user input on the button 461 to the first circuit board 4.

However, embodiments are not limited thereto. The button conductor 463 may contact the button body 4611. That is, the button conductor 463 may connect the button body 4611 to the first circuit board 4.

Figure 15:
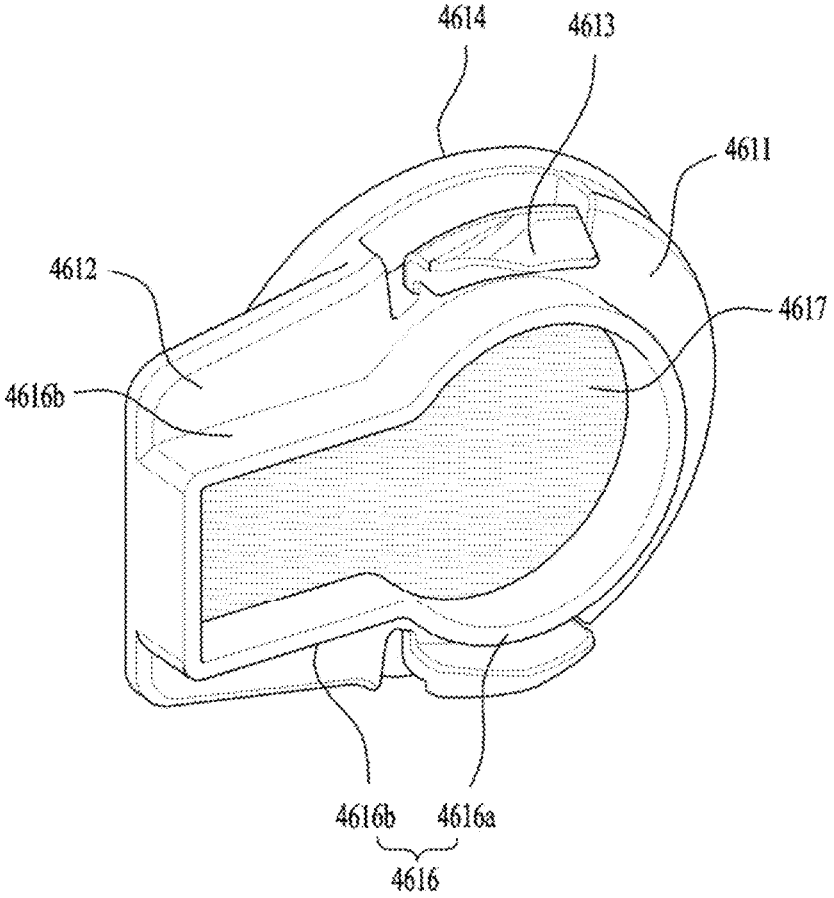
FIG. 15 illustrates a button according to an embodiment of the present disclosure.
Figure 16:
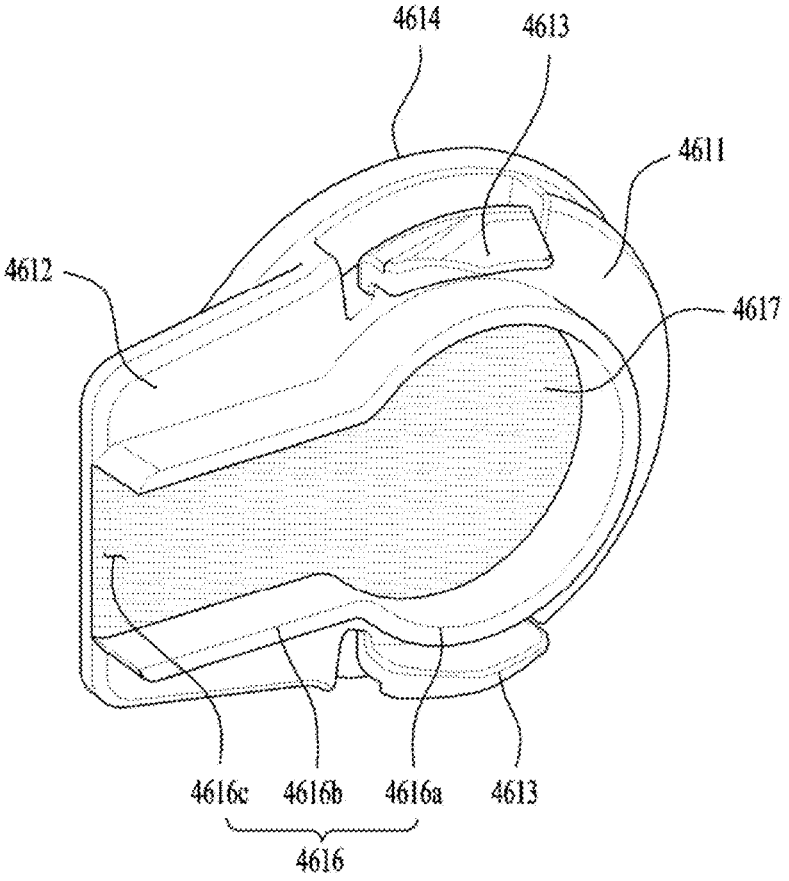
FIG. 16 illustrates a button according to another embodiment of the present disclosure.

FIG. 15 illustrates a button according to an embodiment of the present disclosure. FIG. 16 illustrates a button according to another embodiment of the present disclosure.

Referring to FIGS. 8 and 10, the mounting panel 13 may be formed of a conductive material such as stainless steel. That is, it may be formed of a metal material. The button 461 coupled to the mounting panel 13 may also be formed of a conductive material to immediately recognize the user's body brought into contact with the button 461.

However, when both the mounting panel 13 and the button 461 are formed of a conductive material, a high current applied to the exterior of the cabinet 1 may be transmitted to the first circuit board 4 through the mounting panel 13 and the button 461. When a high current is applied to the first circuit board 4, the first circuit board 4 may be damaged. Accordingly, by blocking an unintended high current from being transferred to the first circuit board 4, the reliability of the first circuit board 4 may be increased and the first circuit board 4 may be protected in a situation in which the current is applied to the exterior of the cabinet 1.

In order to prepare for the above situation, the mounting panel 13 may be formed of a conductive material, and the button 461 may be formed of a non-conductive material. However, when the button 461 is formed of a non-conductive material, an element for implementing the touch button for inputting a control instruction according to a contact signal is required.

Accordingly, as illustrated in FIGS. 15 and 16, the button 461 may include a button touch film 4617 configured to sense whether the user's body is in contact with the button 461. The button touch film 4617 may be fixed to a surface of the button facing the position of the drum 3. In this case, the button 461 may be formed to have a thin thickness such that the button touch film 4617 can recognize a change in capacitance generated on a surface facing the surface to which the button touch film 4617 is fixed.

The first circuit board 4 may be configured to receive a signal sensed by the button touch film 4617. In addition, the button conductor 463 may connect the button touch film 4617 to the first circuit board 4.

As described above, in the case where the mounting panel 13 is formed of a conductive material, and the button 461 is formed of a non-conductive material, any high current applied to the mounting panel 13 or the button 461 may be prevented from being transmitted to the first circuit board 4. Thereby, the first circuit board 4 may be protected.

Referring back to FIG. 8, the button mounting portion 14 may be formed through the mounting panel 13 in a penetrating manner, and the button mounting hole 141 may form a gap in the mounting panel 13.

Particularly, referring to FIG. 10, even when the button 461 is coupled to the button mounting portion 14, the button seating rib 143 may be formed along the circumference of the button mounting hole 141 to form a gap.

A surge test may be performed on the laundry treatment apparatus after the assembly of the laundry treatment apparatus is completed. The surge test may refer to testing the durability of the electronic product by simulating a situation in which an instantaneous overvoltage such as lightning is introduced, using a high peak voltage, a fast rise time, a pulse waveform, and the like.

The surge test may be performed by applying an overvoltage from the outside of the laundry treatment apparatus. That is, an overvoltage may be applied to the cabinet 1. When the overvoltage is introduced into the cabinet 1 in the surge test environment as described above, a spark may be generated in the gap formed by the button mounting portion 14. That is, although the button 461 is formed of a non-conductive material, a spark may be generated in the gap formed by the button mounting portion 14 because the button mounting portion 14 is formed of a conductive material.

The spark may not be limited to the surge test described above, but may also be generated in various environments of usage of the laundry treatment apparatus.

Specifically, a spark may be generated at the button accommodation rib 142 or the button seating rib 143. The generated spark may be introduced into the button touch film 4617 or the button conductor 463 to cause an overcurrent to instantaneously enter the first circuit board 4 to damage the circuit. Accordingly, a structure for preventing the first circuit board 4 from being damaged by the spark may be employed.

Referring to FIG. 15, the button 461 according to an embodiment of the present disclosure may include a button protective rib 4616 for preventing the first circuit board 4 from being damaged by the spark. The button protective rib 4616 may protrude from a surface of the button 461 facing the position of the drum 3.

In particular, the button protective rib 4616 may extend along the circumference of the button touch film 4617. That is, the button protective rib 4616 may extend along the circumference of the button touch film 4617 to prevent the spark generated at the button mounting portion 14 from being transmitted to the button touch film 4617. In other words, the button protective rib 4616 may be arranged to surround the button touch film 4617.

However, the button protective rib 4616 does not need to be provided along the entire circumference of the button touch film 4617 and may be provided only in a portion thereof. In addition, the button protective rib 4616 may be arranged outside the button touch film 4617 to be spaced apart from the button touch film 4617.

That is, the button touch film 4617 may be disposed inside the button protective rib 4616.

In particular, the button touch film 4617 may be arranged on the button body 4611 and the button extension body 4612 of the button 461. Specifically, the button touch film 4617 may be fixed to a surface of the button body 4611 and the button extension body 4612 facing the position of the drum 3.

The button protective rib 4616 may also be provided on the button body 4611 and the button extension body 4612. The button protective rib 4616 may prevent a spark generated at the button accommodation rib 142 or the button seating rib 143 from being transmitted to the button touch film 4617.

In more detail, the button protective rib 4616 may include a first protective rib **4616*a* protruding from the button body 4611 and a second protective rib 4616*b* protruding from the button extension body 4612. The first protective rib 4616*a* and the second protective rib 4616*b*** may be integrated to form a closed curve.

That is, the first protective rib **4616*a* may surround a portion of the button touch film 4617 fixed to the button body 4611, and the second protective rib 4616*b* may surround a portion of the button touch film 4617 fixed to the button extension body 4612. Accordingly, the first protective rib 4616*a* and the second protective rib 4616*b* may surround the entire button touch film 4617**.

According to another embodiment of the present disclosure, the button protective rib 4616 may include a protective rib cut-open portion **4616*c* formed by cutting away a portion of the second protective rib 4616*b*. The protective rib cut-open portion 4616*c* may be formed by cutting away a portion of the second protective rib 4616*b* disposed on a side facing away from the first protective rib 4616*a*. Thus, the first protective rib 4616*a* and the second protective rib 4616*b* may be integrated, and one side on which the protective rib cut-open portion 4616***c* is provided may be open to form an open curve of the protective rib 4616.

Although the protective rib cut-open portion 4616*c* is provided, the button protective rib 4616 may sufficiently prevent the first circuit board 4 from being damaged by the spark because the portion of the button protective rib provided with the protective rib cut-open portion 4616*c* is spaced apart from the portion where the spark is generated.

The protective rib cut-open portion 4616*c* may be open to one side of the button protective rib 4616, thereby improving assemblability in a process of attaching the button touch film 4617. That is, even when the protective rib cut-open portion 4616*c* is provided, the first circuit board 4 may be sufficiently prevented from being damaged, and the button touch film 4617 may be easily attached. Accordingly, the button touch film 4617 may be more closely attached to the button 461, thereby enhancing the recognition of the button touch film 4617.

The button protective rib 4616 may be disposed to surround a portion of the button conductor 463. In particular, the button protective rib 4616 may be disposed to surround at least a portion of the button conductor 463. Accordingly, the button protective rib 4616 may prevent the spark generated in the button mounting portion 14 from being transmitted to the button conductor.

A spark may be generated at the button seating rib 143. The spark may be generated from one side of the button seating rib 143 toward the opposite side facing the one side. When the button protective rib 4616 is positioned on the path through which the spark is transmitted, the button protective rib 4616 may more effectively prevent the spark from being transmitted to the button touch film 4617 or the button conductor 463.

To this end, the button protective rib 4616 may be formed to have a protruding height greater than or equal to the extension length of the button coupling body 4613. When the button protective rib 4616 protrudes longer than the button coupling body 4613, the button protective rib 4616 may more effectively block sparks generated from the button seating rib 143 because the button coupling body 4613 may be coupled to the button seating rib 143.

That is, the free end of the button protective rib 4616 may be positioned closer to the first circuit board 4 than the button seating rib 143. In this case, the button protective rib 4616 may be provided to block the space between the portions of button seating rib 143 facing each other. Accordingly, the button protective rib 4616 may effectively prevent the first circuit board 4 from being damaged by the spark.

Figure 17:
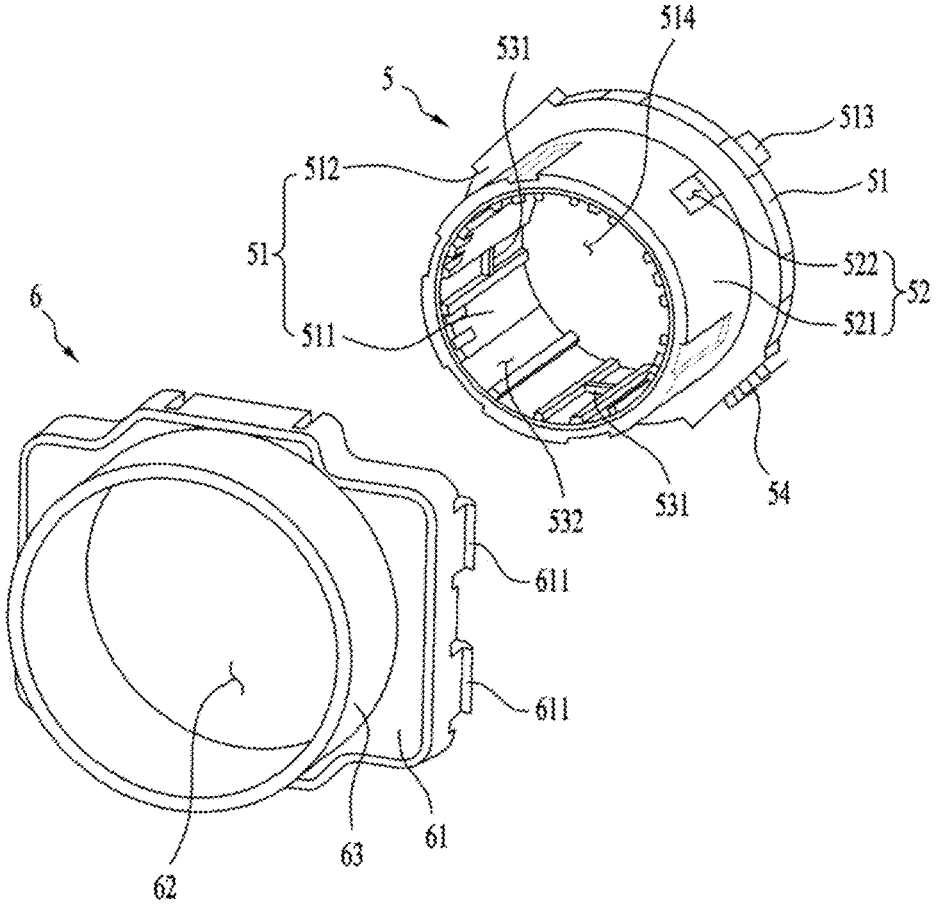
FIGS. 17 and 18 show an example of an encoder and an encoder cover provided in the interface.

As shown in FIG. 17, the encoder 5 may include a fixed part 51 fixed to the first circuit board 4 such that the display part 8 is fixed thereto, a rotary part 52 rotatably arranged on the fixed part 51 with the actuator 7 fixed thereto, and a signal generator 54 configured to generate an electrical signal upon rotation of the rotary part 52.

The fixed part 51 may include a fixed body 512 fixed to the first circuit board 4, a support body 511 extending from the fixed body 512, the rotary part 52 being rotatably fixed to the support body, and a body through-hole 514 formed through the fixed body and the support body and connected to the board through-hole 42 (and connected to the first boss through-hole).

The fixed body 512 may be formed in a cylindrical shape. The circumferential surface of the fixed body 512 or one surface of the fixed body (the surface facing the first circuit board) may be provided with a board fastening portion 513. In this case, the first circuit board 4 may be provided with an encoder fixing hole 44 (see FIG. 5) into which the board fastening portion 513 is inserted.

As shown in FIG. 5, multiple substrate fastening portions 513 and multiple encoder fixing holes 44 may be provided, and the encoder fixing holes 44 may be arranged to surround the board through-hole 42.

As shown in FIG. 17, a fastening body fixing portion 531 and a positioning groove 532 may be provided inside the body through-hole 514. The fastening body fixing portion 531 may fasten the display part 8 to the fixed part 51. The positioning groove 532 may prevent the display part 8 from rotating (to fix the position of the display part) when the display part 8 is inserted into the body through-hole 514.

The fastening body fixing portion 531 may be provided with a protrusion protruding from at least one of the support body 511 and the fixed body 512 toward the center of the body through-hole 514. The figure shows an example case where the fastening body fixing portion 531 is provided on the support body 511.

The positioning groove 532 may be formed by concavely bending one surface of the fixed part 51 having the body through-hole 514. In this case, the positioning groove 532 may be arranged along the longitudinal direction of the body through-hole 514.

The rotary part 52 may include a rotational body 521 rotatably coupled to the support body 511. The rotational body 521 needs to have a rotational body through-hole through which the support body 511 is arranged.

The rotational body 521 may be provided with a shaft fastening portion 522 to which the actuator 7 is fastened. The shaft fastening portion 522 may be a fastening hole formed through the circumferential surface of the rotational body 521, or may be a fastening groove formed by concavely bending the circumferential surface of the rotational body 521.

The signal generator 54 may include a magnet fixed to the rotational body 521, a sensor arranged on the fixed body 512 or the support body 511 to sense magnetic force, and a terminal connecting the sensor and the first circuit board 4. The magnet may include a plurality of permanent magnets spaced apart along the circumferential surface of the rotational body 521.

Figure 18:
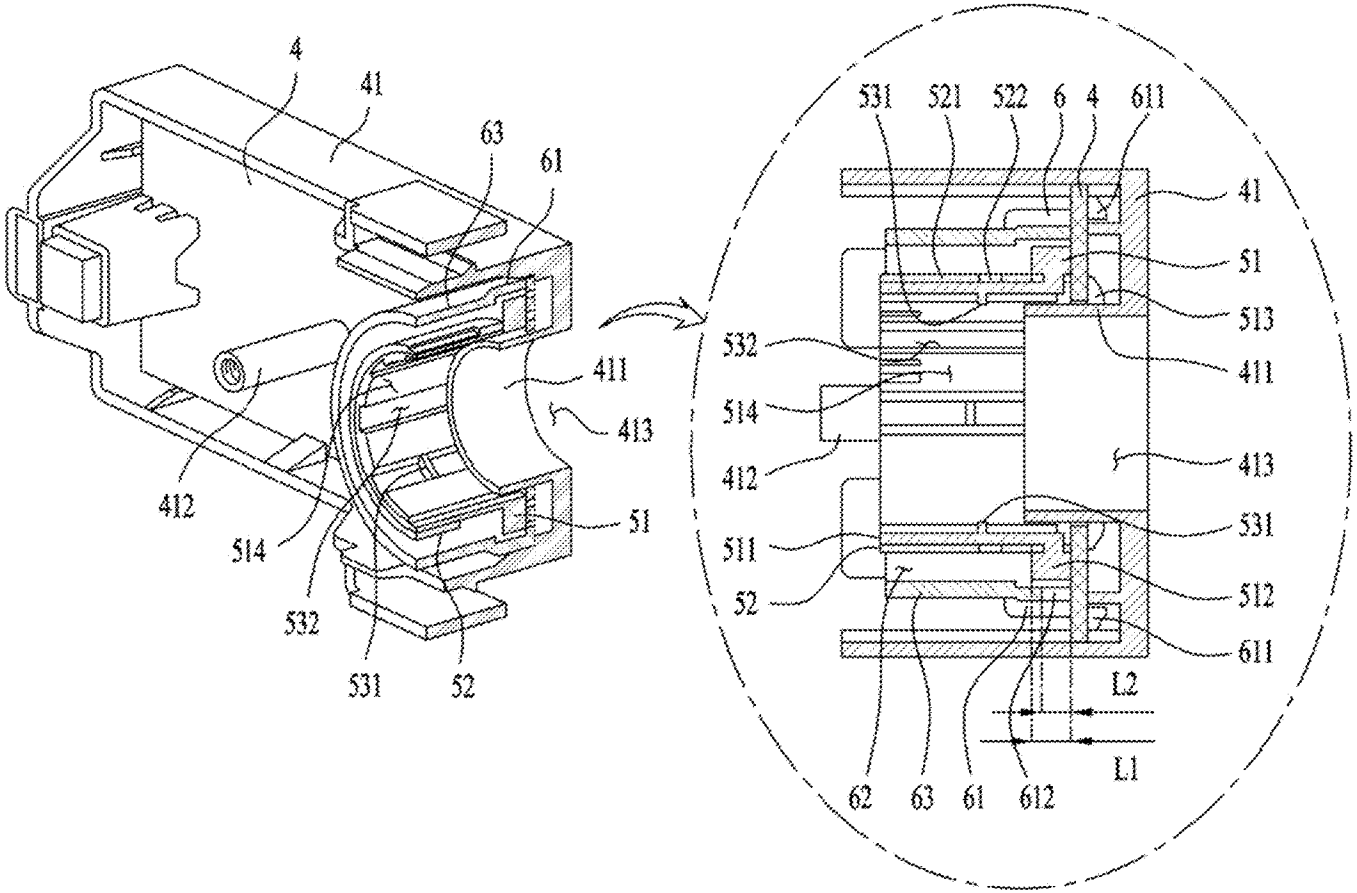

As shown in FIG. 18, the first circuit board 4 to which the encoder 5 is connected may be coated with an insulating material. The coating is intended to minimize the possibility that water is supplied to the first circuit board 4 to cause short circuiting. To prevent the rotational body 521 from being fixed to the support body 511 by the insulating material when the insulating material is applied onto one surface (the surface facing the mounting panel) of the first circuit board 4, the interface P may further include an encoder cover 6.

The encoder cover 6 may be fixed to the first circuit board 4 and formed in a pipe shape to surround the encoder 5. That is, as shown in the figure, the encoder cover 6 may may include a fixed body cover 61 fixed to the first circuit board 4 and arranged to surround the fixed body 512, and a cover through-hole 62 formed through the fixed body cover 61 to receive the encoder 5 inserted thereinto.

The fixed body cover 61 may be provided with a board fastening portion 611, and the first circuit board 4 may be provided with an encoder cover fixing hole 45, to which the board fastening portion 611 is fixed. Multiple board fastening portions 611 and multiple encoder cover fixing holes 45 may be provided, and the encoder cover fixing holes 45 may be arranged to surround the board fastening portion 513.

In order to discharge water introduced into the fixed body cover 61, a cover outlet 612 may be further provided on the circumferential surface of the fixed body cover 61. The cover outlet 612 is preferably disposed at the lowermost end of the circumferential surface of the fixed body cover 61.

The above-described insulating material is applied to the first circuit board 4 after both the encoder 5 and the encoder cover 6 are coupled to the first circuit board 4. The insulating material sprayed onto a partial region of the first circuit board 4 (the space outside the encoder cover) is introduced into the encoder cover 6 through the cover outlet 612. In this process, the distance L1 from the first circuit board to the top of the fixed body 512 may be set to be greater than or equal to the distance L2 from the first circuit board to the top of the cover outlet 612 such that the insulating material is blocked from being supplied to the rotational body 521.

The encoder cover 6 may further include a support body cover 63 extending from the fixed body cover 61 to surround the rotational body 521 (to surround the support body). The support body cover 63 may restrict movement of the actuator 7 in the radial direction of the cover through-hole 62. Accordingly, the support body cover 63 may prevent the actuator 7 from being separated from the rotational body 521.

Figure 19:
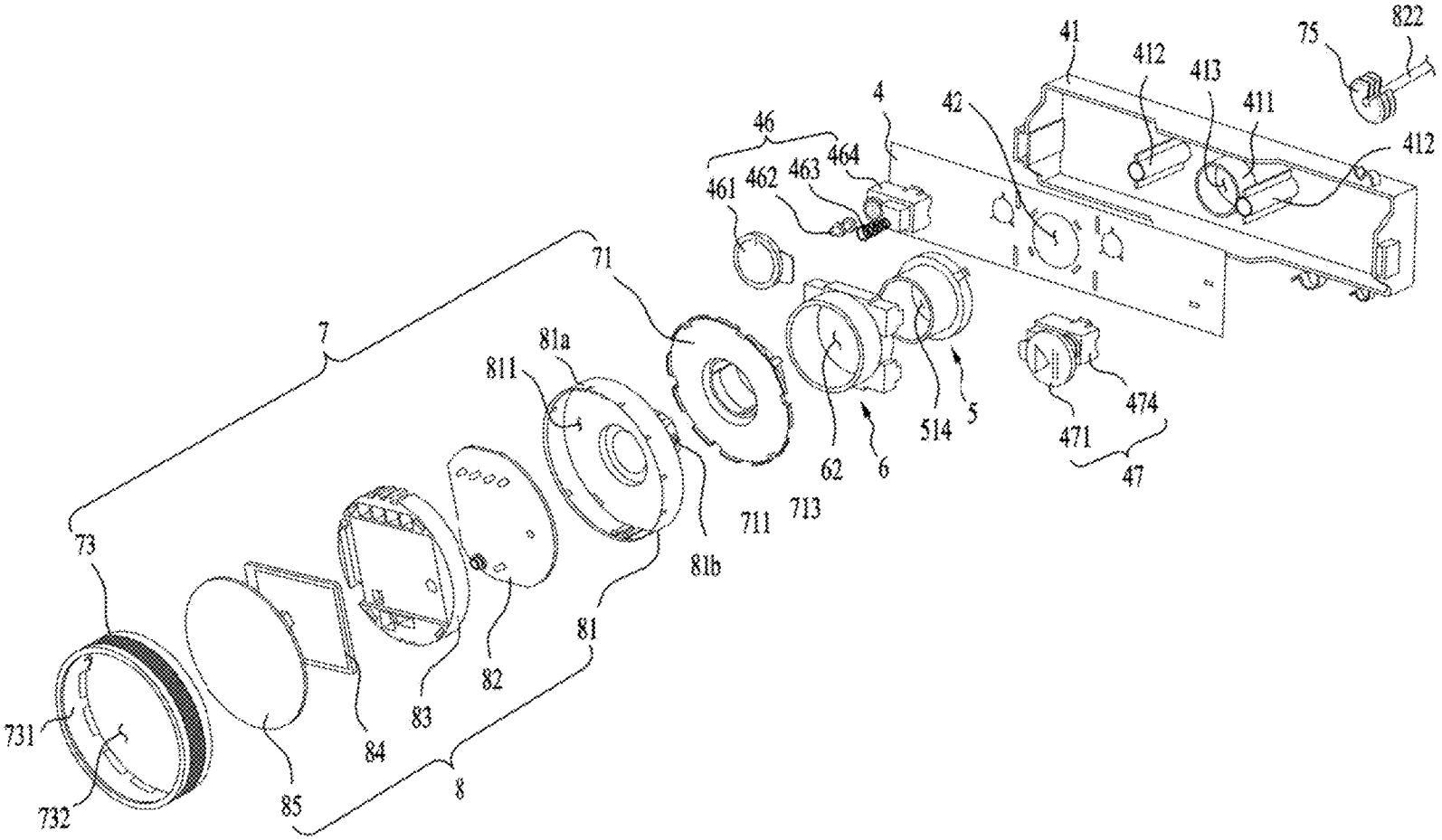
FIG. 19 shows an example of an actuator and indicator provided in the interface.

As shown in FIG. 19, the actuator 7 may include a shaft 71 extending through the mounting panel 13 and fixed to the rotational body 521, and a handle 73 fixed to the shaft 71 and positioned outside the cabinet 1.

The cabinet 1 is provided with the panel through-hole 134 (see FIG. 3) formed through the mounting panel 13, and the shaft 71 may be inserted into the panel through-hole 134.

Figure 20:
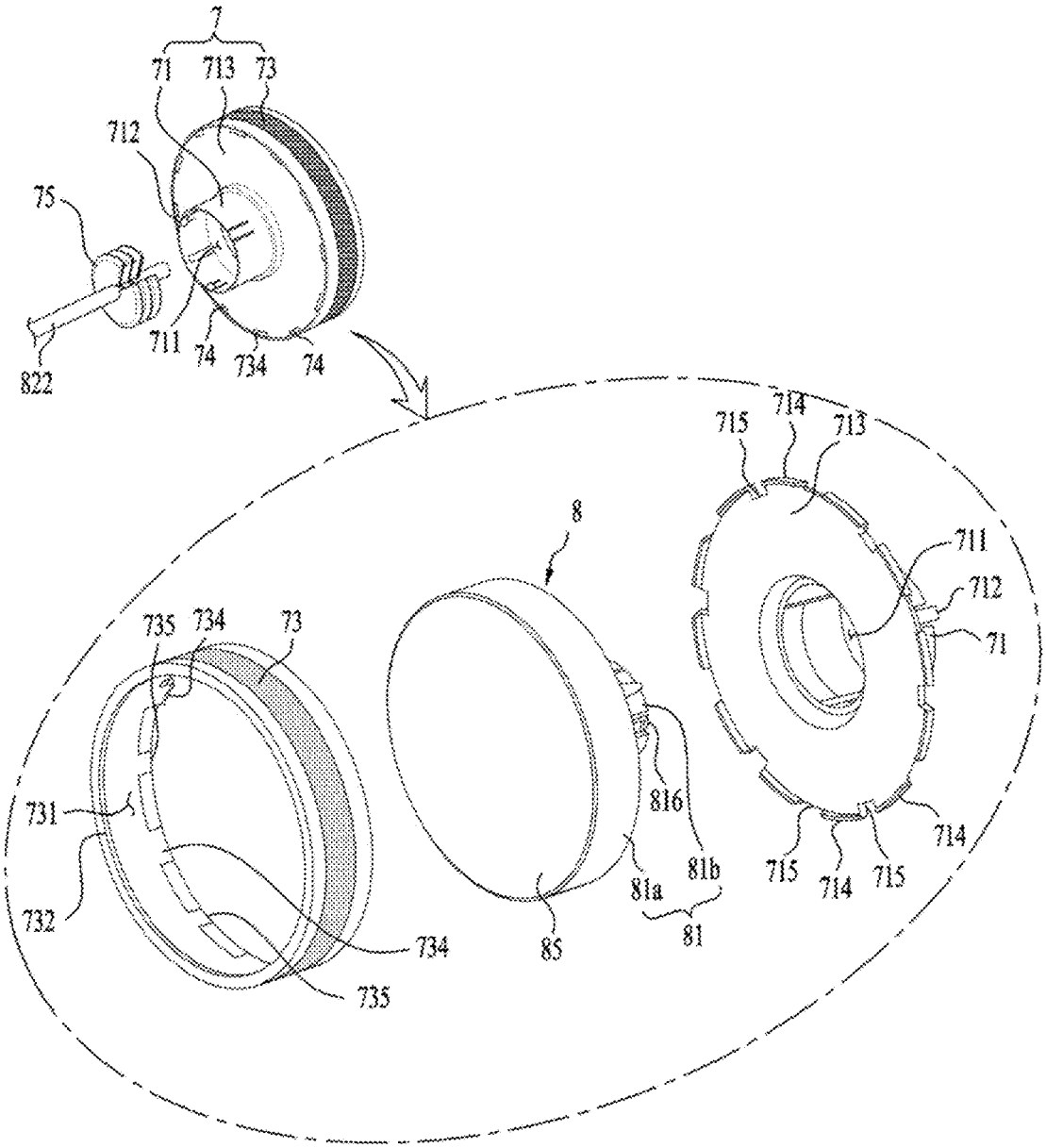
FIGS. 20 and 21 show a structure of the actuator.

As shown in FIG. 20, the shaft 71 may be provided as a pipe with a shaft through-hole 711 formed therein. The rotational body 521 provided in the encoder is inserted into the shaft through-hole 711, and the rotational body fastening portion 712 provided on the circumferential surface of the shaft 71 and disposed inside the shaft through-hole 711 is coupled to the shaft fastening portion 522 provided on the rotational body. Accordingly, the shaft 71 is fixed to the rotational body 521 by the rotational body fastening portion 712 and the shaft fastening portion 522.

The handle 73 is fixed to the shaft 71 so as to be disposed outside the cabinet 1, and the user may apply the force for rotation of the rotational body 521 to the shaft 71 using the handle 73.

The handle 73 may include an accommodation space 731 formed in the handle to communicate with the shaft through-hole 711, and a handle through-hole 732 formed through one surface of the handle 73 to allow the accommodation space 731 to communicate with the outside.

When the diameter of the handle 73 is set to be greater than the diameter of the shaft 71, the shaft 71 may further include a base 713 to which the handle 73 is fixed. The base 713 may be configured as a disk fixed to the circumferential surface of the shaft 71.

The handle 73 and the base 713 may be coupled to each other by a base fastening portion 734 provided on the handle 73 and a handle fastening portion 714 provided on the base 713.

Figure 21:
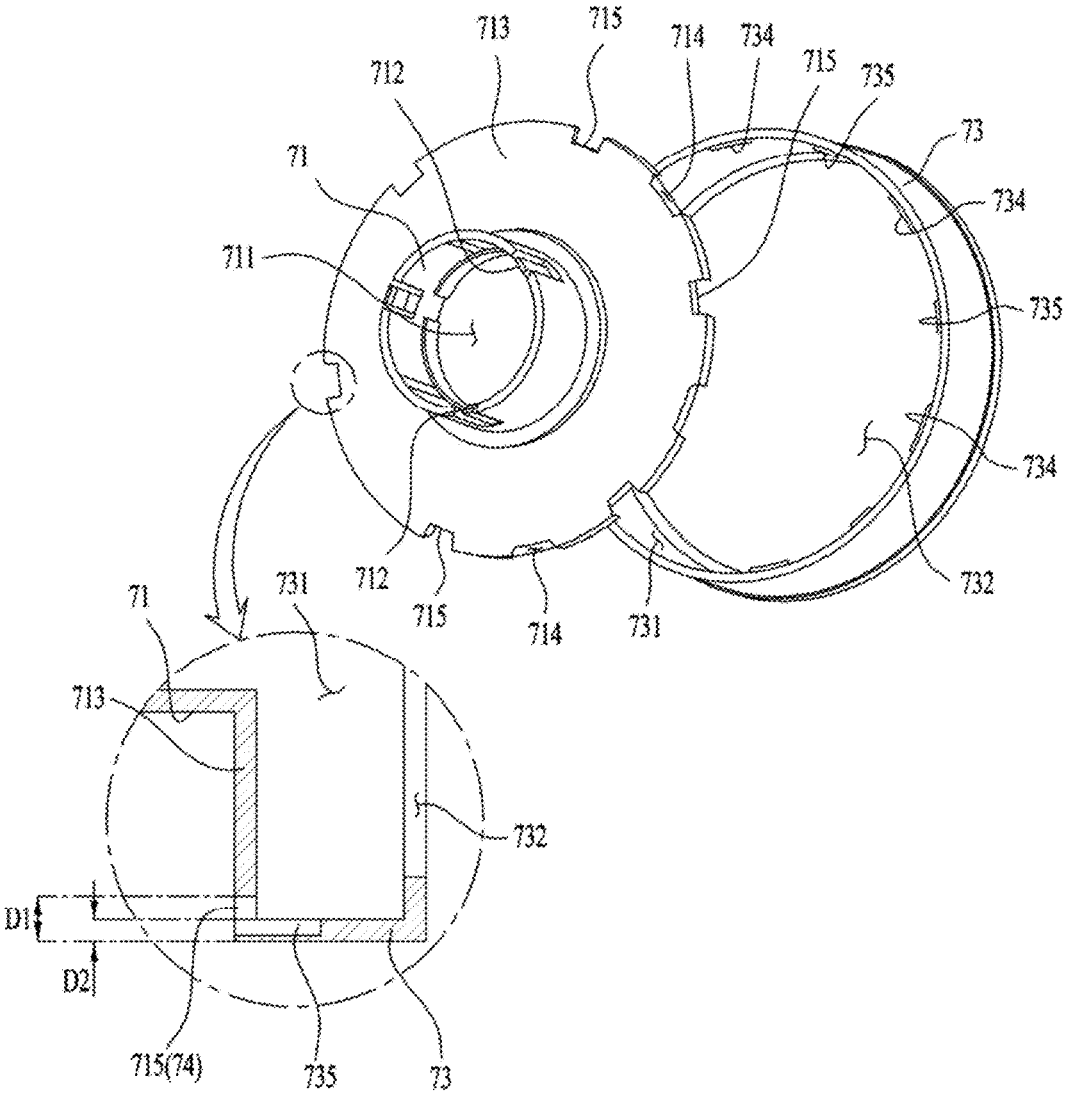

As shown in FIG. 21, the base fastening portion 734 may be provided with multiple protrusions fixed to the handle so as to be positioned in the accommodation space 731, and the handle fastening portion 714 may be configured as a groove provided on the base 713 to accommodate the protrusions.

In order to facilitate coupling of the handle 73 and the base 713, the handle 73 may have a fastening guide 735 disposed between one base fastening portion 734 and another base fastening portion 734, and the base 713 may have a guide groove 715 into which the fastening guide 735 is inserted. The guide groove 715 may be provided by bending the circumferential surface of the base 713 toward the shaft through-hole 711.

A handle outlet 74 may be further provided in either the handle 73 or the base 713 to discharge water or foreign substances introduced into the handle 73 from the handle 73. As shown in FIG. 21, the depth D1 of the guide groove 715 (the length from the edge of the base to the bottom surface of the guide groove) may be set to be greater than the height D2 of the fastening guide 735 (the length from the handle to the free end of the fastening guide). In this case, the handle outlet 74 may be set as a space defined between the guide groove 715 and the fastening guide 735.

Figure 22:
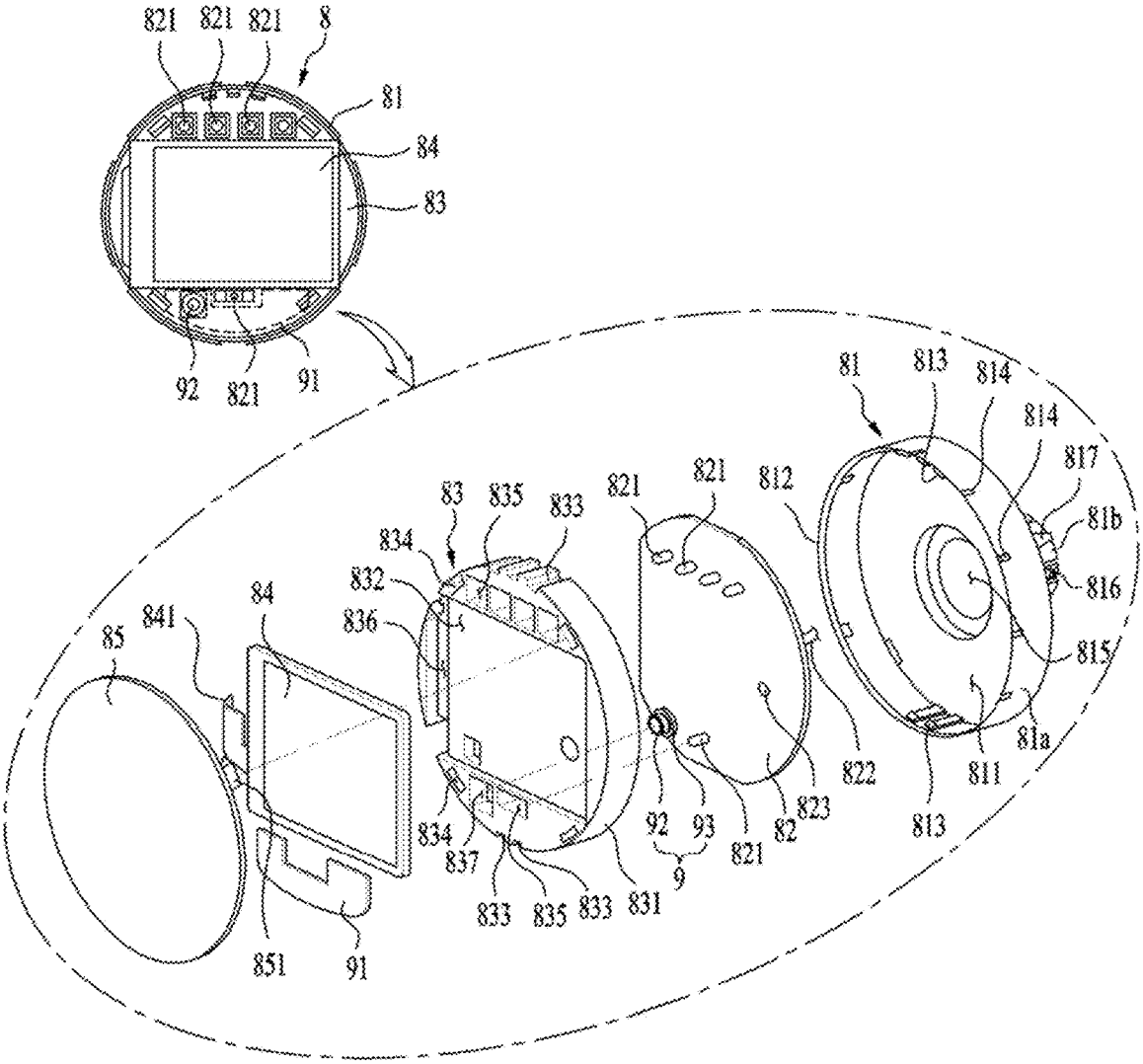
FIGS. 22 and 23 show a structure of a display part.

FIG. 22 shows an example of the display part 8. The display part 8 may include a housing 81 fixed to the fixed body 512 of the encoder and positioned inside the accommodation space 731 of the actuator, a display 84 fixed to the housing and configured to display information (information related to the control, operation or the like of the laundry treatment apparatus), and a circuit board (second circuit board or display circuit board) 82 arranged in the housing and provided with a circuit to control the display 84.

The housing 81 may include a fastening body 81*b* inserted into the body through-hole 514 through the shaft through-hole 711 and fixed to the fixed body 512, and an accommodation body 81*a* fixed to the fastening body 81*b* and positioned in the accommodation space 731.

The accommodation body 81*a* may be formed in any shape as long as it can be inserted into the accommodation space 731. FIG. 11 shows an example of the accommodation body 81*a* having a cylindrical shape.

A mounting space 811 is formed in the accommodation body 81*a*. The mounting space 811 communicates with the accommodation space 731 provided in the handle through an accommodation body through-hole 812 (wherein the accommodation body through-hole communicates with the handle through-hole). That is, the accommodation body through-hole 812 is provided on a side facing the position of the handle through-hole 732 in the space provided by the accommodation body 81*a*.

Figure 23:
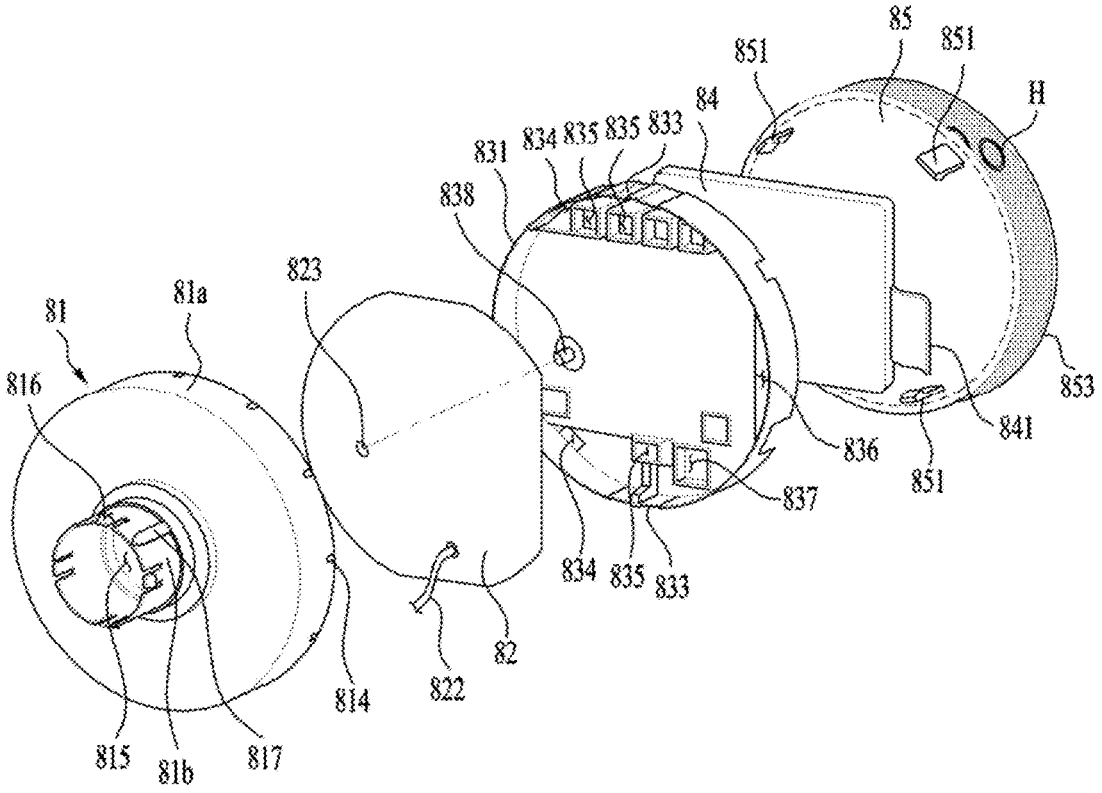

The fastening body 81*b* may be formed in any shape as long as it can be inserted into the shaft through-hole 711 and the encoder body through-hole 514. FIG. 23 shows an example of the fastening body 81*b* having a cylindrical shape. The fastening body 81*b* is provided with a fastening body through-hole 815 connected to the mounting space 811.

The circumferential surface of the fastening body 81*b* may be provided with a fixed body fastening portion 816. The fixed body fastening portion 816 serves to fix the housing 81 to the fastening body fixing portion provided in the encoder.

Further, the circumferential surface of the fastening body 81*b* may be further provided with multiple positioning protrusions 817.

The positioning protrusions 817 may have a shape insertable into the positioning grooves 532 provided in the encoder, and the positioning protrusions 817 are arranged at positions corresponding to the positions of the positioning grooves 532. The positioning protrusions 817 and the positioning grooves 532 serve to minimize the risk that the fastening body 81*b* fails to be coupled to the fastening body fixing portion 531 when the fastening body 81*b* is inserted into the body through-hole 514 (to ensure coupling of the fixed body fastening portion with the fastening body fixing portion).

As shown in FIG. 22, the second circuit board 82 is inserted into the mounting space 811, and a wire 822 connected to the second circuit board 82 is withdrawable out of the housing 81 through the fastening body through-hole 815. The second circuit board 82 may be provided with multiple lamps 821.

The second circuit board 82 may control the display 84 to display preset information according to electrical signals generated by the signal generator 54 when the handle 73 is rotated.

To maintain the spacing between the second circuit board 82 and the display 84 and to prevent damage to the lamps 821, a mounting part 83 positioned between the display 84 and the second circuit board 82 may be provided in the mounting space 811.

The mounting part 83 may include a mounting body 831 fixed to the accommodation body 81*a* and positioned inside the mounting space 811. The mounting body 831 may be formed in any shape as long as it can be inserted into the mounting space 811. FIG. 22 shows an example of the mounting body 831 formed in a roughly cylindrical shape.

One surface of the mounting body 831 is provided with a seating groove 832 to which the display 84 is fixed. The seating groove 832 may be provided with a connector through-hole 836. A connector (a flexible PCB or the like) 841 provided on the display 84 may be inserted into the connector through-hole 836 and connected to the second circuit board 82.

The mounting body 831 may be provided with lamp through-holes 835 into which the lamps 821 are inserted. The number of the lamp through-holes 835 provided may be the same as the number of the lamps 821, and the positions of the lamp through-holes 835 should be set in a space of the mounting body positioned above the seating groove 832, or a space of the mounting body positioned below the seating groove 832. This is intended to ensure that light emitted from the lamps 821 is transmitted to the outside of the housing 81 through the lamp through-holes 835.

The mounting part 83 is fixed to the housing 81 by a mounting body fastening portion 813 provided on the accommodation body 81*a* and an accommodation body fastening portion 833 provided on the mounting body 831. The mounting body fastening portion 813 may include multiple protrusions disposed inside the mounting space 811, and the accommodation body fastening portion 833 may include a groove provided on the circumferential surface of the mounting body 831 (one surface of the mounting body that contacts the accommodation body) such that the mounting body fastening portion 813 is fixed thereto.

The number of the mounting body fastening portions 813 may be the same as the number of the accommodation body fastening portions 833, and the positions of the mounting body fastening portions 813 and the accommodation body fastening portions 833 may correspond to each other.

In order to enhance the fastening of the mounting body 831, the accommodation body fastening portion 833 may be provided with an upper fastening portion arranged at a higher position than the seating groove 832 and a lower fastening portion arranged at a lower position than the seating groove 832. Unlike the example shown in the figure, the accommodation body fastening portion 833 may be provided on the left and right sides of the accommodation groove.

To prevent water and foreign substances from being introduced into the display 84 and the second circuit board 82, the accommodation body 81*a* may be further provided with a cover 85.

The cover 85 may be fixed to at least one of the accommodation body 81*a* and the mounting body 831, and be arranged to close the accommodation body through-hole 812. The cover 85 may include a material having transparency that allows the information displayed on the display 84 and the light emitted by the lamps 821 to be visible from the outside.

When the cover 85 is configured to be fixed to the mounting body 831, the cover 85 may include cover fixing protrusions 851 that protrude toward the mounting body 831, and the mounting body 831 may include fixing protrusion fastening portions 834 to which the cover fixing protrusions 851 are fastened.

As shown in FIG. 23, the second circuit board 82 may also be fixed to the mounting body 831. That is, the mounting part 83 may be provided with a protrusion 838 protruding from the mounting body 831 toward the second circuit board 82, and the second circuit board 82 may be provided with a protrusion through-hole 823 into which the protrusion 838 is inserted.

The cover 85 may further include a coversheet 853 that reduces the transparency of the cover. The transparency of the coversheet may be set to make it difficult to see the interior of the mounting space 811 from the outside (the transparency of the coversheet may be set lower than the transparency of the cover). The coversheet 853 may be fixed to the surface of the cover 85, and a letter or symbol H may be provided in the area of the coversheet through which the lamp through-holes 835 are projected.

As shown in FIG. 22, the interface P may further include a selector 9 configured to receive a control instruction input to select a control instruction displayed on the display 84.

The selector 9 may be configured to sense whether the user's body is in contact with the cover 85 to determine whether the control instruction displayed on the display 84 is selected by.

That is, the selector 9 may include a sensor 93 provided on the second circuit board 82 to sense static electricity on the user's body, and conductors 91 and 92 connecting the sensor 93 to the cover 85. The conductors 91 and 92 may include a first conductor 91 fixed to the cover 85, and a second conductor 92 connected at one end to the first conductor 91 and at the opposite end to the sensor 93. In this case, the mounting body 831 may be provided with a conductor through-hole 837 into which the second conductor 92 is inserted.

The first conductor 91 is a means to expand the area available for user contact facilitate the input of control instructions. In the interface P with the above-described structure, a display region R1 is formed in the upper space of the cover 85 and an input region R2 is formed in the lower space of the cover 85, as shown in FIG. 1. Thus, by setting the area of the first conductor 91 to be wide, the area of the input region R2 may expanded, and accordingly the user may be allowed more easily input control instructions. The area of the first conductor 91 may be set to ¼ to ½ of the area of the cover 85.

The interface P with the above-described structure may enable display of control instructions, search of displayed control instructions, and selection of a displayed control instruction, and minimize the space required for installation. However, the interface P with the above-described structure requires a means to prevent water or foreign substances from being introduced into the display part 8 and the actuator 7, or to discharge the water or foreign substances to the outside.

Figure 24:
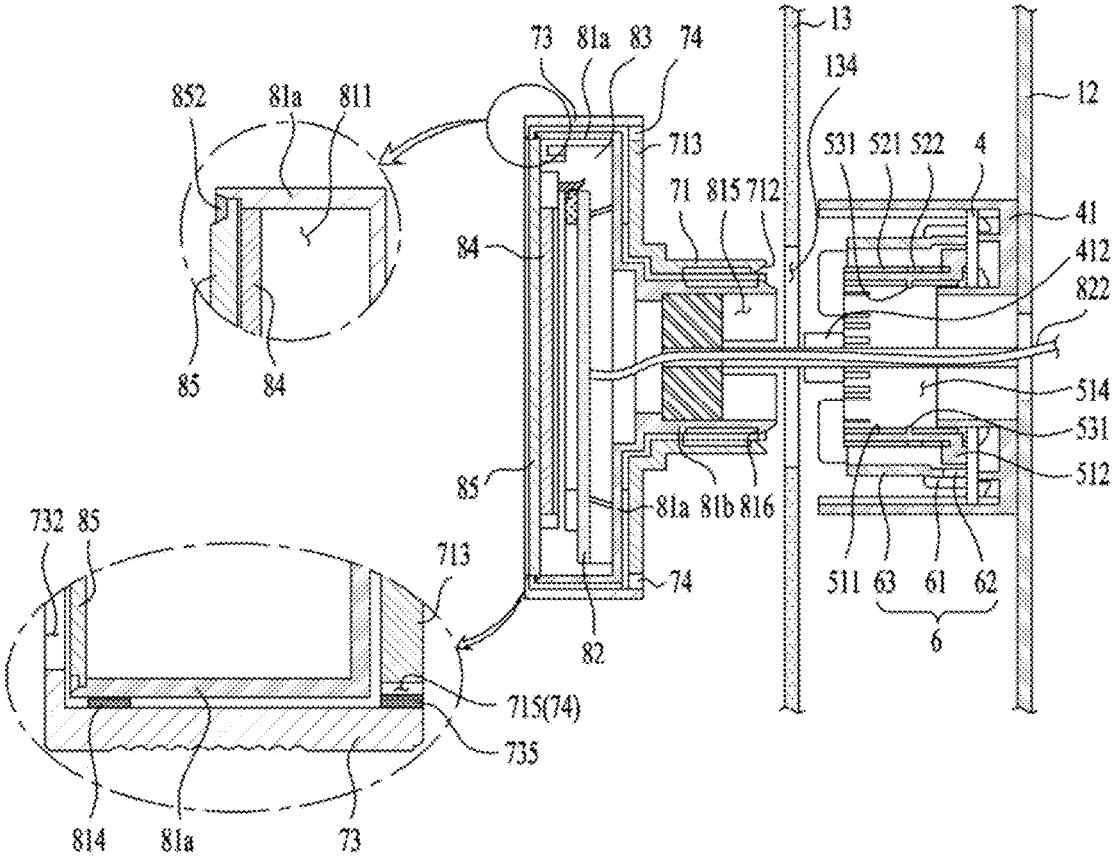
FIG. 24 shows an example of an assembly structure of the interface.

As shown in FIG. 24, the actuator 7 include a means to discharge water or foreign substances introduced into the handle through-hole 732 to the outside of the accommodation space 731, and the display part 8 may include a means to block water or foreign substances from being introduced into the housing 81.

As previously described, the actuator 7 is capable of discharging water or foreign substances introduced into the accommodation space 731 to the outside of the accommodation space through the handle outlet 74 provided in the handle.

The display part 8 may include a sealing portion (or fastening body sealing portion) 75, which prevents foreign substances from being introduced into the fastening body through-hole 815, and a cover sealing portion 852, which seals the space between the cover 85 and the accommodation body through-hole 812.

The cover sealing portion 852 may include an adhesive material that is sprayed onto the accommodation body 81*a* along the edge of the cover 85 to fill the space between the cover 85 and the accommodation body 81*a* and fix the cover 85 to the accommodation body 81*a*.

The sealing portion 75 may be inserted into the fastening body through-hole 815 to fix the position of the wire 822 and to block foreign substances such as water from being introduced into the fastening body through-hole 815.

Figure 25:
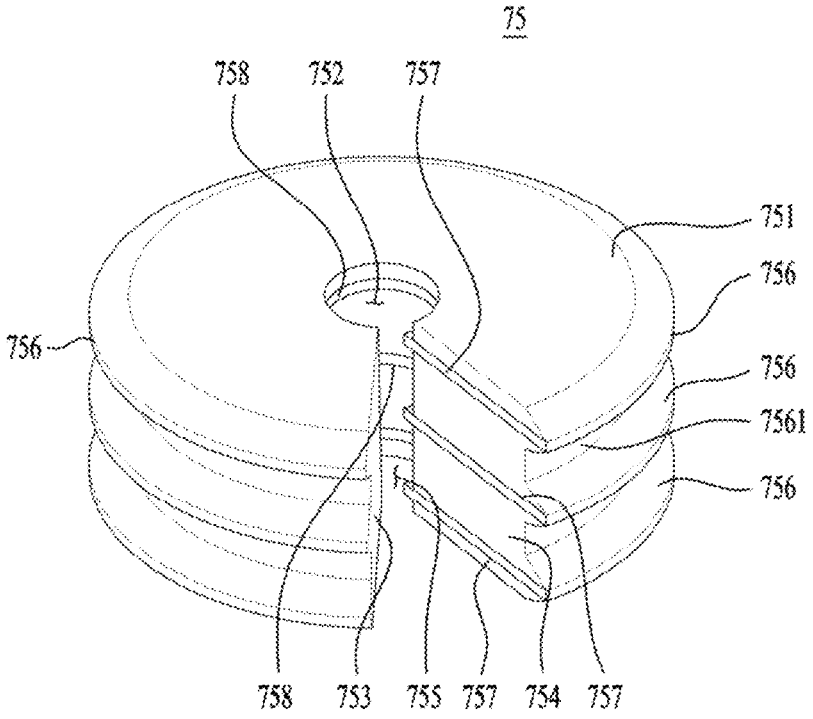
FIG. 25 shows an example of a sealing portion provided to the actuator.

FIG. 25 shows an example of the sealing portion 75. The sealing portion 75 of FIG. 25 includes a sealing body 751 inserted into the fastening body through-hole 815, a sealing body through-hole 752 formed through the sealing body 751 to allow the wire 822 to be inserted thereinto, and cut-open portion 753, 754, and 755 formed by cutting away a circumferential surface of the sealing body 751 to connect the circumferential surface of the sealing body 751 to the sealing body through-hole 752.

The sealing body 751 may be formed in any shape as long as it can be inserted into the fastening body through-hole 815. FIG. 25 shows an example of the sealing body 751 formed in a cylindrical shape.

The diameter of the sealing body 751 may be set to be greater than the diameter of the fastening body through-hole 815. In this case, the material of the sealing body 751 may be rubber, silicone or the like having a relatively large resilience such that the fastening body through-hole 815 may be closed through press-fitting.

The cut-open portion may include a first cut-open surface 753 extending from a circumferential surface of the sealing body 751 toward the center of the sealing body through-hole 752, a second cut-open surface 754 extending from the circumferential surface of the sealing body 751 toward the center of the sealing body through-hole 752 and spaced apart from the first cut-open surface 753, and an cut-open groove 755 formed between the first cut-open surface 753 and the second cut-open surface 754. The wire 822 may be inserted into or withdrawn from the sealing body through-hole 752 via the an cut-open groove 755.

The spacing between the first and second cut-open surfaces 753 and 754 may be set to a length allowing the two cut-open surfaces 753 and 754 to contact each other to close the cut-open groove 755 when the sealing body 751 is inserted into the fastening body through-hole 815.

In order to more reliably prevent foreign substances from being introduced into the space formed between the circumferential surface of the sealing body 751 and the fastening body through-hole 815, the circumferential surface of the sealing body 751 may be further provided with a first contact protrusion 756.

The first contact protrusion 756 may include a band-shaped protrusion extending from the first cut-open surface 753 to the second cut-open surface 754 along the circumferential surface of the sealing body 751. The first contact protrusion 756 may include multiple band-shaped protrusions arranged spaced apart from each other along the height direction of the sealing body 751.

The sealing body 751 may be further provided with a second contact protrusion 757 to prevent foreign substances from being introduced into the cut-open groove 755. The second contact protrusion 757 may protrude from at least one of the first cut-open surface 753 and the second cut-open surface 754 toward the other one.

Further, the second contact protrusion 757 may connect the first contact protrusion 756 to the sealing body through-hole 752, or connect the sealing body through-hole 752 to a point 7561 positioned between two first contact protrusions 756.

To prevent foreign substances from being introduced into the space between the wire 822 and the sealing body through-hole 752, the sealing body through-hole 752 may be provided with a third contact protrusion 758. This is because even when the diameter of the sealing body through-hole 752 (the diameter formed when the sealing body is inserted into the fastening body through-hole) is set smaller than the diameter of the wire 822, the possibility of foreign substances entering through the sealing body through-hole 752 cannot be excluded.

The third contact protrusion 758 may include a band-shaped protrusion that protrudes from a side of the sealing body 751 defining the sealing body through-hole 752 toward the center of the sealing body through-hole 7552. The third contact protrusion 758 may extend from the first cut-open surface 753 to the second cut-open surface 754 and be connected to the second contact protrusion 757.

Hereinafter, the assembly process for the interface P described above will be described with reference to FIG. 24.

The first circuit board 4 is fixed to the case 41 with the encoder 5 and the encoder cover 6 coupled thereto. The surface of the first circuit board 4 fixed to the case 41 has an insulating material applied thereto.

The case 41 may be fixed to the cabinet 1 through the mounting panel 13, or may be fixed to the cabinet 1 through the panel support 12. When the case 41 is fixed to the mounting panel 13, the case 41 may be fixed to the mounting panel 13 by a bolt that is fixed to the second boss 412 through the mounting panel 13, and the mounting panel 13 may be fixed to the panel support 12 by a bolt or the like.

When the shaft 71 of the actuator 7 is inserted into the panel through-hole 134 provided in the mounting panel after the mounting panel 13 is fixed to the panel support 12, the shaft 71 may be fixed to the rotational body 521 of the encoder, and the fastening body 81*b* of the display part may be fixed to the support body 511 of the encoder.

That is, when the shaft 71 is inserted into the panel through-hole 134, the rotational body fastening portion 712 provided on the shaft is fixed to the shaft fastening portion 522 provided on the rotational body, and the fixed body fastening portion 816 provided on the fastening body 81*b* is fixed to the fastening body fixing portion 531 provided in the body through-hole 514. Accordingly, the actuator 7 is rotatably fixed to the first circuit board 4 by the rotational body 521, and the display part 8 is fixed to the first circuit board 4 by the support body 511.

In this case, the wire 822 withdrawn to the outside through the fastening body through-hole 815 may be inserted into the cabinet 1 through the body through-hole 514 provided in the encoder, the first boss through-hole 413 provided in the case, and the wire passing hole 123 provided in the panel support.

The interface P with the structure described above will display preset control instructions (search and change control instructions) on the display 84 whenever the user turns the handle 73 (whenever the encoder generates an electrical signal).

When a desired control instruction is displayed on the display 84, the user may select the displayed control instruction using the selector 9, and the control instruction selected using the selector 9 may be initiated when the user inputs an execution instruction through the second input unit 47.

Since the handle 73 is rotatably coupled to the first circuit board 4, while the housing 81 of the display part is fixed to the first circuit board 4, it is necessary to keep the distance between the handle 73 and the housing 81 constant. This is because if the distance between the handle 73 and the housing 81 is not kept constant, the rotation of the handle 73 may be constrained.

In order to keep the distance between the handle 73 and the housing 81 constant, at least one of the circumferential surface of the accommodation body 81*a* or the accommodation space 731 provided in the handle may be further provided with a spacer.

FIG. 22 shows one example of the spacer. The spacer 814 in FIG. 22 is a protrusion protruding from the circumferential surface of the accommodation body 81*a* toward the circumferential surface of the handle 73. The spacer 814 may include multiple protrusions equally spaced apart from each other along the circumferential surface of the accommodation body 81*a*. As shown in the figure, the spacer may include a protrusion protruding from the circumferential face of the handle 73 toward the circumferential surface of the accommodation body 81*a*.

The above-described structure, control method, and assembly method of the interface and laundry treatment apparatus are merely intended to illustrate an example of the interface and laundry treatment apparatus, and the scope of the present disclosure is not limited to the above-described embodiments.

The invention claimed is:

1. A laundry treatment apparatus comprising:

a cabinet made of a metal material, the cabinet comprising a mounting panel that defines a panel inlet and a button mounting portion;

a drum rotatably disposed inside the cabinet and configured to receive laundry, the drum defining a drum inlet that faces the panel inlet;

a button coupled to the button mounting portion and exposed to an outside of the cabinet, the button being made of a non-conductive material;

a button touch film fixed to a surface of the button facing the drum, the button touch film being configured to sense whether a user is in contact with the button; and a first circuit board configured to receive a sensing signal from the button touch film.

2. The laundry treatment apparatus of claim 1, wherein the button comprises a button protective rib that protrudes from the surface of the button toward the drum, and wherein the button touch film is disposed in a space defined by the button protective rib and the surface of the button.

3. The laundry treatment apparatus of claim 2, wherein the button comprises:

a button body disposed at the button mounting portion and exposed to the outside of the cabinet, the button body being configured to be contacted by the user; and a button extension body that extends from an edge of the button body and is disposed inside the cabinet.

4. The laundry treatment apparatus of claim 3, wherein the button touch film is fixed to a surface of the button body and a surface of the button extension body, wherein the surfaces of the button body and the button extension body define the surface of the button facing the drum, and wherein the button protective rib is disposed at the button body and the button extension body.

5. The laundry treatment apparatus of claim 4, further comprising a button conductor that connects the button touch film to the first circuit board, wherein the button conductor connects a portion of the button touch film fixed to the button extension body to the first circuit board.

6. The laundry treatment apparatus of claim 5, wherein the button protective rib comprises:

a first protective rib disposed at the button body; and a second protective rib disposed at the button extending body, and wherein the button protective rib is a single body that includes the first protective rib and the second protective rib and defines a closed curve.

7. The laundry treatment apparatus of claim 5, wherein the button protective rib comprises:

a first protective rib disposed at the button body; and a second protective rib disposed at the button extending body, wherein the second protective rib defines a protective rib cut-open portion that is an opening at a side facing away from the first protective rib, and wherein the button protective rib is a single body that includes the first protective rib and the second protective rib and defines an open curve having the protective rib cut-open portion.

8. The laundry treatment apparatus of claim 3, wherein the button mounting portion comprises:

a button mounting hole that passes through the mounting panel;

a button accommodation rib that extends from an edge of the button mounting hole toward the drum; and a button seating rib that extends from the button accommodation rib toward a center of the button mounting hole, and wherein the button comprises a button coupling body that extends from the button body toward the drum and couples the button body to the mounting panel.

9. The laundry treatment apparatus of claim 8, wherein the button coupling body is coupled to the button seating rib and supports the button body.

10. The laundry treatment apparatus of claim 9, wherein the button protective rib is spaced apart from the button accommodation rib in a direction away from the button accommodation rib.

11. The laundry treatment apparatus of claim 9, wherein a protruding height of the button protective rib from the button body toward the drum is greater than or equal to an extension length of the button coupling body from the button body toward the drum.

12. The laundry treatment apparatus of claim 8, wherein an end of the button protective rib facing the drum is positioned closer to the first circuit board than the button seating rib.

13. The laundry treatment apparatus of claim 8, wherein the button mounting portion defines a rib cut-open portion at a portion of the button accommodation rib, the rib cut-open portion extending to a portion of the button seating rib corresponding to the portion of the button accommodation rib, and wherein the button extension body is disposed in the rib cut-open portion.

14. The laundry treatment apparatus of claim 2, further comprising a button conductor that connects the button touch film to the first circuit board, wherein the button protective rib surrounds at least a portion of the button conductor.

15. The laundry treatment apparatus of claim 1, wherein the cabinet defines a panel through-hole that passes through the mounting panel, wherein the first circuit board is disposed inside the cabinet, and wherein the laundry treatment apparatus further comprises:

an encoder comprising (i) a fixed part fixed to the first circuit board, (ii) a rotary part rotatably coupled to the fixed part, and (iii) a signal generator configured to generate an electrical signal based on rotation of the rotary part.

16. The laundry treatment apparatus of claim 15, further comprising an actuator, the actuator comprising:

a shaft inserted into the panel through-hole and coupled to the rotary part, the shaft defining a shaft through-hole that passes through the shaft and receives the rotary part inserted thereinto; and a handle fixed to the shaft and positioned outside of the cabinet, the shaft being configured to receive force for rotating the shaft, wherein the handle has:

an accommodation space that is defined inside the handle and in fluid communication with the shaft through-hole, and a handle through-hole that passes through a surface of the handle and fluidly connects the accommodation space with an outside of the handle.

17. The laundry treatment apparatus of claim 16, further comprising a display part, the display part comprising:

a fastening body inserted into the shaft through-hole and fixed to the fixed part;

an accommodation body fixed to the fastening body and disposed inside the accommodation space; and a display that is fixed to the accommodation body and faces the handle through-hole, the display being configured to display information.

18. The laundry treatment apparatus of claim 17, wherein the display is configured to display preset information based on the electrical signal generated by the signal generator.

19. The laundry treatment apparatus of claim 15, wherein the button mounting portion comprises a plurality of button mounting holes that pass through the mounting panel and are spaced apart from the panel through-hole.

20. The laundry treatment apparatus of claim 15, wherein the button mounting portion comprises a pair of button mounting holes that pass through the mounting panel, and the panel through-hole being defined between the pair of button mounting holes.

* * * * *